US007319213B2

(12) United States Patent
Tsontzidis et al.

(10) Patent No.: US 7,319,213 B2
(45) **Date of Patent: *Jan. 15, 2008**

(54) MICROWAVE PACKAGING WITH INDENTATION PATTERNS

(75) Inventors: Sandra M. Tsontzidis, Brampton (CA); Laurence M. C. Lai, Mississauga (CA); Neilson Zeng, North York (CA)

(73) Assignee: Graphic Packaging International, Inc., Marietta, GA (US)

( * ) Notice: Subject to any disclaimer, the term of this patent is extended or adjusted under 35 U.S.C. 154(b) by 74 days.

This patent is subject to a terminal disclaimer.

(21) Appl. No.: 11/183,053

(22) Filed: Jul. 15, 2005

(65) Prior Publication Data

US 2006/0011620 A1 Jan. 19, 2006

Related U.S. Application Data

(63) Continuation-in-part of application No. 10/008,670, filed on Nov. 7, 2001, now Pat. No. 6,919,547.

(51) Int. Cl.
*H05B 6/80* (2006.01)
*B65D 81/34* (2006.01)

(52) U.S. Cl. ..... 219/730; 219/728; 99/DIG. 14; 426/107; 426/234; 426/243

(58) Field of Classification Search ..... 219/725–735, 219/759, 762; 426/107, 109, 118, 234, 241, 426/243; 99/DIG. 14
See application file for complete search history.

(56) References Cited

U.S. PATENT DOCUMENTS 4,794,005 A 12/1988 Swiontek
5,026,958 A 6/1991 Palacios
5,217,768 A 6/1993 Walters et al.
5,310,977 A 5/1994 Stenkamp et al.
5,317,118 A 5/1994 Brandberg et al.
5,350,904 A 9/1994 Kemske et al.
5,585,027 A 12/1996 Young
5,698,127 A 12/1997 Lai et al.

(Continued)

FOREIGN PATENT DOCUMENTS

JP 3-505020 10/1991

(Continued)

*Primary Examiner*—Philip H. Leung
(74) *Attorney, Agent, or Firm*—Womble Carlyle Sandridge & Rice, PLLC

(57) ABSTRACT

Indentation patterns in microwave packaging materials can enhance the baking and browning effects of the microwave packaging materials on food. The indentation patterns can provide venting to either channel moisture from one area of the food product to another, trap moisture in a certain area to prevent it from escaping, or channel the moisture completely away from the food product. The indentation patterns can cause the microwave packaging material underneath a food product to be slightly elevated above the cooking platform in the base of a microwave. The indentation patterns can lessen the heat sinking effect of the cooking platform by providing an air gap for insulation. Elevating the base of the microwave packaging material further allows more incident microwave radiation to propagate underneath the microwave packaging material to be absorbed by the food product or by microwave interactive materials in the microwave packaging material that augment the heating process.

32 Claims, 16 Drawing Sheets

U.S. PATENT DOCUMENTS

| | | | |
|---|---|---|---|
| 6,150,647 | A | 11/2000 | Anderson et al. |
| 6,204,492 | B1 | 3/2001 | Zeng et al. |
| 6,919,547 | B2 | 7/2005 | Tsontzidis et al. |
| 2003/0085224 | A1 | 5/2003 | Tsontzidis et al. |

FOREIGN PATENT DOCUMENTS

| | | |
|---|---|---|
| WO | WO 89/11772 | 11/1989 |
| WO | WO 01/22778 | 3/2001 |
| WO | WO 03/041451 A1 | 5/2003 |
| WO | WO 2004/020310 | 3/2004 |

MICROWAVE PACKAGING WITH INDENTATION PATTERNS

CROSS-REFERENCE TO RELATED APPLICATION

The present application is a continuation-in-part of U.S. patent application Ser. No. 10/008,670, which was filed Nov. 7, 2001. U.S. patent application Ser. No. 10/008,670 is scheduled to issue as U.S. Pat. No. 6,919,547 on Jul. 19, 2005. U.S. patent application Ser. No. 10/008,670 is incorporated herein by reference, in its entirety.

BACKGROUND OF THE INVENTION

1. Field of the Invention

This invention relates generally to microwave interactive packaging materials, and more specifically to the introduction of indentation patterns into such materials.

2. Description of the Related Art

Scoring and molding of stiff packaging materials during the manufacture of packaging products is a standard practice in the packaging industry. For example, stiff packaging material, e.g., paperboard, is regularly scored to create fold lines for easier manipulation of the packaging material into different configurations, for example, boxes or trays. Similarly, flat packaging material may be manipulated by compression molding devices to form product packaging with sidewalls from the originally flat material. Such compression molding techniques may be augmented by scoring areas along which the sidewalls are formed before placing the packaging material into a compression mold. These scoring and molding techniques are frequently used in the food packaging industry to create boxes, pans, trays, and other packaging for food products. The score lines created in these processes are typically on the order of 1 mm wide or more.

Another use of such scoring and molding techniques in the food packaging industry is to increase the rigidity of the packaging material. For example, configurations such as parallel ribs, concentric circular channels, and perimeter depressions have been variously molded into flat packaging substrates, e.g., paper or paperboard, to create greater resistance to bending moments of the packaging material. Generally such molded features are quite large, with widths typically ranging from one-quarter to one-eighth of an inch. Non-functional features are also regularly molded into food packaging, for example, designs or patterns that increase the aesthetic attributes of the packaging or indicia that assists with the marketing or identification of the product. In order to create such molded features in a packaging substrate, either functional or aesthetic, matched male-female embossing tooling is generally used. Such tooling is usually "special purpose," that is it is built for the specific use desired and can therefore be quite expensive.

BRIEF SUMMARY OF THE INVENTION

In accordance with one aspect, the present invention incorporates the use of well known scoring or, if desired, molding techniques in the packaging industry to create novel indentation patterns in packaging materials for microwave food products. Methods for making such microwave packaging materials (e.g., microwave radio frequency packaging material) with the novel indentation patterns are also disclosed herein. Food product packaging materials are generally manufactured using dimensionally stable substrates. Microwave packaging materials may or may not also incorporate microwave interactive elements designed either to augment the cooking power of the microwave energy or to shield portions of the food product from over-exposure to the microwave energy. In accordance with one aspect of the present invention, whether the packaging material is merely a substrate, or includes microwave interactive elements, the benefits of the indentation patterns of the present invention provide similar enhanced cooking results.

In accordance with one aspect of the present invention, the novel indentation patterns enhance the baking and browning effects of the microwave packaging material on the food product in a microwave oven in several ways. First, the indentation patterns may provide venting to channel moisture trapped beneath the food product. Depending upon the type of food product and the desired effect, the indentation patterns can be designed to variously channel moisture from one area of the food product to another, trap moisture in a certain area to prevent it from escaping, and channel the moisture completely away from the food product. In one embodiment, concave indentation patterns become channels for directing moisture trapped underneath the food product. In another embodiment, the indentation patterns may be convex protrusion patterns designed to trap moisture in certain areas by creating a seal between the top of the protrusion and the bottom of the food product.

The indention patterns, the spacing between elements of a pattern, and the width and depth of the indentations may be dictated by the type of food product to be heated and the desired cooking effect. In one scenario, greater or fewer indentation lines may be scored depending upon such factors as, for example, the moisture content of the food product, the thickness of the food product, characteristics of the food product (e.g., fat content), and the surface area occupied by the food product. In order to increase the moisture venting capacity, and in accordance with one example, the indention patterns may be made wider or deeper to accommodate more flow volume.

In accordance with one aspect of the present invention, the convex protrusions in the substrate caused by the indentation patterns cause the microwave packaging material underneath a food product to be slightly elevated above the glass tray, or other cooking platform, in the base of a microwave. In normal microwave operation, the glass tray acts as a large heat sink, absorbing much of the heat generated by either the microwave heating of the food product or the microwave interactive materials, thereby lessening the ability of the microwave packaging material augment the heating and browning of the food product. The convex protrusions from the indentation patterns lessen the heat sinking effect of the glass tray by raising the microwave packaging material above the glass tray, thereby providing an air gap for insulation.

According to one aspect of the present invention, elevating the base of the microwave packaging material further allows more microwave radiation to reach the food product, and thereby increases the cooking ability of the microwave oven. The slight gap caused by the convex protrusions in the substrate allows additional incident microwave radiation to propagate underneath the microwave packaging material and be absorbed by the food product or by microwave interactive materials in the microwave packaging material that augment the heating process. Forming a deeper indention pattern also increases the gap between the microwave packaging material and the glass tray, and thereby increases the insulation and microwave propagation benefits.

Numerous novel indentation patterns may be used to achieve the benefits of this invention. A sampling of exemplary indentation patterns is disclosed in the written description and drawings herein. However, these exemplary patterns are by no means exhaustive of the possible indentation patterns that might be used to achieve the novel benefits disclosed. Further, and in accordance with one aspect of the present invention, the novel indentation patterns may be designed for microwave packaging materials and specific food products to maximize the benefits of moisture transfer and venting, insulation against heat sinks to reduce wasteful heat transfer to the heat sinks (e.g., turntable trays), and increased microwave propagation, either individually or in combination.

In accordance with one aspect of the present invention, the microwave packaging material includes a laminate material and an indentation pattern. The indentation pattern can be in the form of indentations in the laminate material. The laminate material can include a microwave interactive material layer supported upon a substrate. In accordance with this aspect, the indentations are at least partially defined by the microwave interactive layer and substantially maintain the integrity of the microwave interactive layer. It can be advantageous for the indentations not to be fold lines, so that the structural integrity of the microwave packaging material is maintained or not excessively lessened. The structural integrity of the microwave packaging material can also be maintained or not excessively lessened by virtue of the indentations being discontinuous with a peripheral edge of the laminate material.

The indentations can extend a distance into a first side of the laminate material, with that distance being less than a thickness defined between opposite first and second sides of the laminate material, so that the second side of the laminate material is absent of protrusions respectively corresponding to the indentations.

According to one aspect of the present invention, a first side of the microwave interactive layer faces away from the substrate and includes multiple substantially flat, coplanar surfaces that are at least partially separated from one another respectively by the indentations. Each of the indentations can be respectively positioned between at least two of the substantially flat, coplanar surfaces of the first side of the microwave interactive layer. In a plan view of the first side of the microwave interactive layer, a summation of all areas of the first side that are in the form of the substantially flat, coplanar surfaces can exceed a summation of all areas of the first side that are in the form of the indentations.

In accordance with one aspect of the present invention, each of the indentations includes a concave portion defined by the first side of the microwave interactive layer, and the concave portion extends below the substantially flat, coplanar surfaces of the first side of the microwave interactive layer while the substantially flat, coplanar surfaces are facing upward. In accordance with another aspect, each of the indentations includes a convex portion defined by the first side of the microwave interactive layer, and the convex portion extends above the substantially flat, coplanar surfaces of the first side of the microwave interactive layer while the substantially flat, coplanar surfaces are facing upward.

Other aspects and advantages of the present invention will become apparent from the following.

DETAILED DESCRIPTION OF THE INVENTION

Figure 1A:
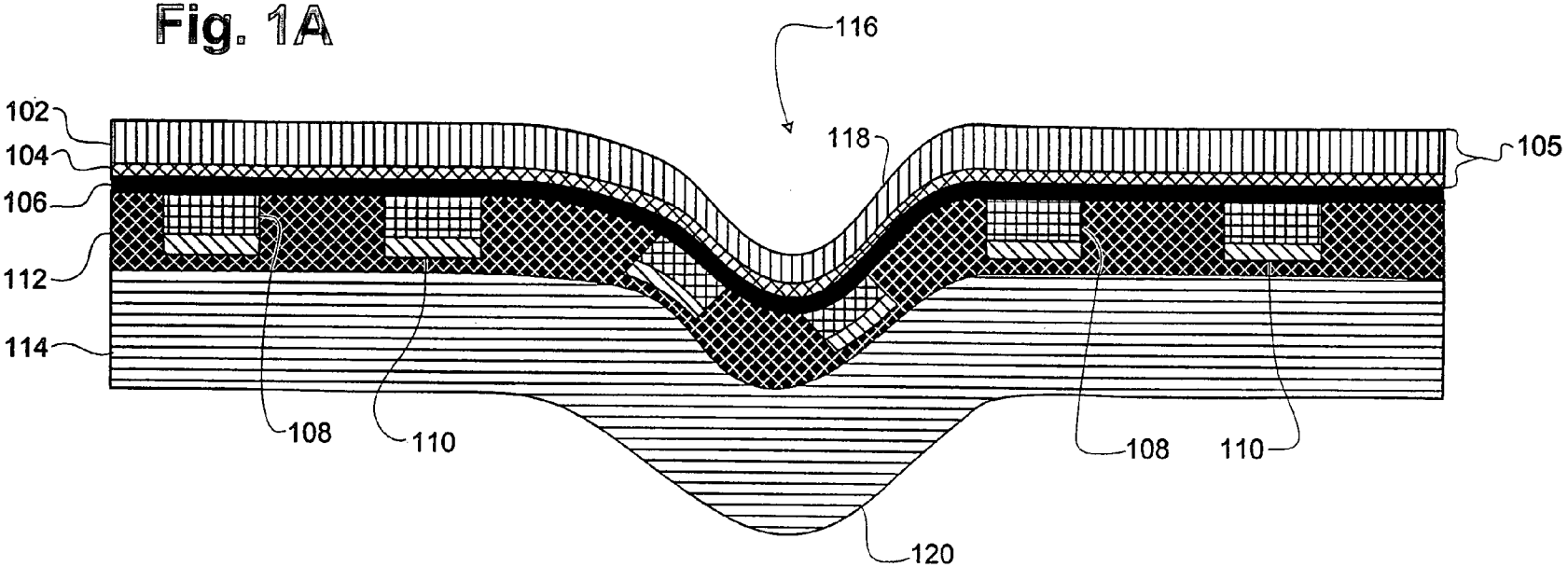
FIG. 1A is an elevation view in cross-section of an exemplary embodiment of a swatch of microwave packaging material with an indentation pattern.

In an exemplary embodiment of the invention, abuse-tolerant microwave interactive packaging material is enhanced by the methodologies of the present invention to produce a microwave interactive substrate with the added benefit of indentations that can be in the form of indention lines and can also be in other shapes. Acceptable examples of the types of microwave interactive packaging material that can be enhanced by the methodologies of the present invention include those disclosed in U.S. Pat. No. 6,204,492B1, and those available under the MicroRite brand name from Graphic Packaging International, Inc. of Marietta, Ga. However, this is merely an exemplary embodiment for the purposes of description of a manufacturing process for microwave packaging herein. It should be recognized that the present invention can be applied to any paper, paperboard, plastic, or other packaging base substrates that incorporate metallic and/or non-metallic elements that interact with microwave radiation in a microwave oven for heating, browning, and/or shielding a food product to be cooked in the package.

In the exemplary embodiment, the microwave packaging material is manufactured in a continuous process involving applications to and combinations of various continuous substrate webs. The continuous substrate webs may be of any width and generally depend upon the size of the manufacturing equipment and the size of the stock rolls of substrates obtained from the manufacturer. However, the process need not be continuous, and can be applied to individual substrate sheets. Likewise, each of the process steps herein described may be performed separately and at various times. Further, the inventive technique may be applied to microwave packaging after it has fully completed the normal production process.

In an exemplary process, a polyester substrate, for example, 48-gauge polyester film web, is covered with a microwave interactive material, for example, aluminum, to create a structure that heats upon impingement by microwave radiation. Such a substrate layer when combined with a dimensionally stable substrate, for example, paperboard, is commonly known as a susceptor. The polyester-aluminum combination alone is referred to herein as a "susceptor film." When aluminum is used to create the microwave interactive layer of a susceptor film, it may be applied to the polyester substrate, for example, by sputter or vacuum deposition processes, to a thickness of between 50-2,000 Å. The completed susceptor film layer is next coated with a dry bond adhesive, preferably on the aluminum deposition layer, rather than the side with the exposed polyester for creating a laminate with at least one other substrate layer. Bonding the additional substrate to the aluminum deposition allows the polyester to act as a protective layer for the microwave interactive elements as will become apparent later in this description.

Optionally, the susceptor film is next laminated to a layer of metal foil. In the exemplary embodiment, aluminum foil of about 7 μm in thickness is joined to the susceptor film by the dry bond adhesive and the application of heat and/or pressure in the lamination process. Typical ranges of acceptable foil thickness for microwave packaging material may be between 6 μm and 100 μm.

The foil layer is then covered with a patterned, etchant resistant coating. The resist coat in this exemplary process is applied in a pattern to create an abuse-tolerant foil pattern. The abuse-tolerant foil pattern can be of the type described in U.S. Pat. No. 6,204,492 B1, which is hereby incorporated herein by reference, in its entirety. The abuse-tolerant foil pattern can also be of any of the types available in MicroRite brand packaging material that is available from Graphic Packaging International, Inc. of Marietta, Ga. In the exemplary embodiment, the resist coat is a protective dry ink that may be printed on the foil surface by any known printing process, for example, web, offset, or screen-printing. The resist coat should be resistant to a caustic solution for etching the desired pattern into the metal foil layer.

The abuse-tolerant foil pattern redistributes incident microwave energy by increasing the reflection of microwave energy while maintaining high microwave energy absorption. A repeated pattern of metallic foil segments can shield microwave energy almost as effectively as a continuous bulk foil material while still absorbing and focusing microwave energy on an adjacent food surface. The metallic segments can be made of foil or high optical density evaporated materials deposited on a substrate. High optical density materials include evaporated metallic films that have an optical density greater than one (optical density being derived from the ratio of light reflected to light transmitted). High optical density materials generally have a shiny appearance, whereas thinner metallic materials, such as susceptor films have a flat, opaque appearance. Preferably, the metallic segments are foil segments.

The segmented foil (or high optical density material) structure prevents large induced currents from building at the edges of the material or around tears or cuts in the material, thus diminishing the occurrences of arcing, charring, or fires caused by large induced currents and voltages. The abuse-tolerant design includes a repeated pattern of small metallic segments, wherein each segment acts as a heating element when under the influence of microwave energy. In the absence of a dielectric load (i.e., food), this energy generates only a small induced current in each element and hence a very low electric field strength close to its surface.

Preferably, the power reflection of the abuse-tolerant material is increased by combining the material with the susceptor film layer. In this configuration, a high surface—heating environment is created through the additional excitement of the susceptor film due to the composite action of food interacting with the small metallic segments. When the food interacts with the metallic segments of the abuse-tolerant material, the quasi-resonant characteristic of perimeters defined by the metallic segments can stimulate stronger and more uniform cooking. Unlike a full sheet of plain susceptor material, the present invention can stimulate uniform heating between the edge and center portion of a sheet of the abuse-tolerant metallic material combined with a susceptor film to achieve a more uniform heating effect.

The average width and perimeter of the pattern of metallic segments will determine the effective heating strength of the pattern and the degree of abuse tolerance of the pattern. However, the power transmittance directly toward the food load through the abuse-tolerant metallic material is dramatically decreased, which leads to a quasi-shielding functionality. In the absence of food interacting with the material, the array effect of the small metallic segments still maintains a generally transparent characteristic with respect to microwave power radiation. Thus, the chances of arcing or burning when the material is unloaded or improperly loaded are diminished.

Preferably, each metallic segment has an area less than 5 $mm^2$ and the gap between each small metallic strip is larger than 1 mm. Metallic segments of such size and arrangement reduce the threat of arcing that exists under no-load conditions in average microwave ovens. When, for example, food, a glass tray, or a layer of plain susceptor film contacts the metallic segments, the capacitance between adjacent metallic segments will be raised as each of these substances has a dielectric constant much larger than a typical substrate on which the small metal segments are located. Of these materials, food has the highest dielectric constant (often by an order of magnitude). This creates a continuity effect of connected metallic segments, which then work as a low Q-factor resonate loop, power transmission line, or power reflection sheet with the same function of many designs that would otherwise be unable to withstand abuse conditions. On the other hand, the pattern is detuned from the resonant characteristic in the absence of food. This selectively tuned effect substantially equalizes the heating capability over a fairly large packaging material surface including areas with and without food.

The perimeter of each set of metallic segments is preferably a predetermined fraction of the effective wavelength of microwaves in an operating microwave oven. The predetermined fraction is selected based on the properties of the food to be cooked, including the dielectric constant of the food and the amount of bulk heating desired for the intended food. For example, a perimeter of a set of segments can be selected to be equal to predetermined fractions or multiples of the effective microwave wavelength for a particular food product. Furthermore, a resonant fraction or multiple of the microwave wavelength is selected when the microwave packaging material is to be used to cook a food requiring strong heating, and a smaller, high-density, nested perimeter of a quasi-resonant; fractional wavelength is selected when the microwave packaging material is used to cook food requiring less heating, but more shielding. Therefore, the benefit of concentric but slightly dissimilar perimeters is to provide good overall cooking performance across a greater range of food properties (e.g., from frozen to thawed food products).

Returning to the exemplary process of the present invention, the laminate web of susceptor film, foil, and resist coat is next immersed into and drawn through a caustic bath to etch the foil in the desired pattern. In the exemplary embodiment, a sodium hydroxide solution of appropriate temperature is used to etch the aluminum foil exposed in the areas not covered by the printed pattern of the protective ink. The ink resist coat should also be able to withstand the temperature of the caustic bath. It should be noted that the dry adhesive between the foil and the susceptor film also acts as a protective resist coating to prevent the caustic solution from etching the thin aluminum deposition on the polyester substrate forming the susceptor film.

Upon emersion from the caustic bath, the laminate may be rinsed with an acidic solution to neutralize the caustic, and then rinsed again, with water, for example, to remove the residue of any solution. The laminate web is then wiped dry and/or air-dried, for example, in a hot air dryer. The resulting etched foil pattern of the exemplary embodiment can be of the type disclosed in U.S. Pat. No. 6,204,492 B1 issued to Zeng et al. and provides an abuse-tolerant metallic layer that is generally transmissive to microwave energy when unloaded and provides an increased level of reflective shielding when loaded with a food product. The susceptor film and the abuse tolerant metallic layer can also be like those provided in MicroRite brand packaging material that is available from Graphic Packaging International, Inc. of Marietta, Ga. The susceptor film and the abuse tolerant metallic layer are exemplary types of microwave interactive structures that may be incorporated into the microwave packaging materials contemplated by the present invention.

The laminate web is next coated with an adhesive for a final lamination step to a sturdy packaging substrate, for example, paper, paperboard, or a plastic substrate. If the chosen substrate is paper or paperboard, a wet bond adhesive is preferably used; if the substrate is a plastic, a dry bond adhesive is preferred. Typical types of paper substrates that may be used with this invention range between 10 lb and 120 lb paper. Typical ranges for paperboard substrates that may be used with the present invention include 8-point to 50-point paperboard. Similarly, plastic substrates of between 0.5 mils and 100 mils thickness are also applicable.

The adhesive is applied to the metal foil side of the susceptor film/foil laminate web. Therefore, the adhesive variously covers the resist coat covering the etched foil segments and the exposed dry bond adhesive covering the susceptor film where the foil was etched away. The packaging substrate is then applied to the laminate web and the two are joined together by the adhesive and the application of heat and/or pressure in the lamination process.

In a typical process, the web of microwave packaging laminate is next blanked or die cut into the desired shape for use in particular packaging configurations. For example, the web may be cut into round disks for use with pizza packaging. The impression of indention lines according to the present invention may be implemented as a part of the blanking process, or performed as a separate step before or after the desired packaging shapes have been cut. In one embodiment, the indentations are formed in the polyester side of the packaging material, creating concave depressions when viewed from the polyester side, and convex, protruding uplifts when viewed from the packaging substrate side. Alternatively, the impressions may be made in the packaging substrate side, wherein uplifts are formed protruding from the polyester side of the microwave packaging laminate. The choice of side for impressing the indentation lines depends upon the cooking effect desired as explained in detail below.

In a first embodiment, a blanking die, which normally comprises a sharp cutting edge to cut out the desired shape of a packaging blank from sheets of material or from a web, may be further formed with blunt scoring edges. The blunt edges score indentation lines in the microwave packaging material according to any of numerous patterns that may be designed to provide tailored cooking enhancements for the particular food product being cooked. In this embodiment, the scored indentation lines are formed simultaneously while the shape of the packaging is blanked by the sharp edges of the die. The creation of such dies is relatively inexpensive and the integration or substitution of a die into the manufacturing process is relatively simple. The lines of indentation patterns according to the present invention are generally on the order of 0.5 mm to 1 mm wide, but may be narrower or wider, for example, up to 2-3 mm wide, depending upon the desired effect. The width of the indentation pattern lines is generally narrower than indentations made for increasing the rigidity of a substrate or embossing a decorative pattern as performed in the prior art. The lower end of the indentation lines of the present invention is also narrower than scoring widths used to create fold lines in present packaging processes.

In a second embodiment, the scoring process may be applied to individual packaging blanks after they have been cut from the laminate web. The indentations may be impressed in a single action, for example, by using a die with blunt scoring edges formed in the desired pattern. The indentions may likewise be scored by multiple passes with a blunt scoring edge or an array of scoring edges. Any other scoring process may likewise be used to create the indentations in the microwave packaging material.

In a third embodiment, the indentation lines may be formed by placing the pre-cut microwave packaging blank into a forming mold with male and female sides that mate to create the desired indentation pattern upon the application of pressure. The use of a forming mold is a preferred method when the microwave package is to be, for example, a tray with sidewalls. In this circumstance, the tray is generally formed by compressing a flat blank of microwave packaging material in a mold to thrust portions of the blank into sidewalls of the tray. By additionally fabricating the mold with the indentation pattern protruding in relief from the male side of the mold and a symmetrical groove pattern on the female side of the mold, the indentation pattern in the microwave packaging material may be formed at the same time the tray is pressed. The use of a forming mold may be preferred when deep or wide indentation patterns are desired. In these circumstances the forming mold exerts less stress on the microwave packaging material and is less likely to cut through the microwave packaging material than the scoring methods discussed above.

A cross section of the resultant microwave packaging material 100 with an indentation pattern 116 created by these processes is shown in FIG. 1. The microwave packaging material 100 of this exemplary embodiment is formed of a polyester substrate 102 covered by a thin deposition of aluminum 104 to create a susceptor film 105. When laminated in combination with a dimensionally stable substrate (e.g., paperboard) as is the ultimate result of the microwave packaging material 100, the polyester substrate 102 and aluminum layer 104 function as a susceptor. The aluminum layer 104 is covered with a dry bond adhesive layer 106. As previously described, an aluminum foil layer 108 is adhered to the susceptor film 105 via the dry bond adhesive layer 106. Then a patterned ink resist coat 110 is printed on the foil layer 108 and the exposed foil layer 108 is etched away in a caustic bath. The resultant patterned foil layer 108 remaining after the etching process is shown in FIG. 1 covered by the patterned ink resist coat 110. The patterned foil layer 108 and ink resist coat 110 are covered by a second adhesive layer 112. For the sake of discussion, in this embodiment, the adhesive layer 112 is a wet bond adhesive. The adhesive layer 112 further covers the etched areas between the patterned foil elements 108 and adheres in these areas to the dry bond adhesive layer 106. The final component of this exemplary embodiment is a dimensionally stable paperboard substrate 114 that is adhered to the previous layers by the second adhesive layer 112. Thus the various layers are laminated together to form microwave packaging material 100.

An indention line 116 scored or compressed into the microwave packaging material 100 is shown in FIG. 1. The scoring of microwave packaging material 100 in this embodiment was performed in the polyester layer 102 as indicated by the depiction of the concave portion 118 of the indentation line 116 on the side of the polyester layer 102. The convex portion 120 of the indentation line 116 appears as a protrusion in the paperboard substrate 114, although the protrusion may be less pronounced or absent entirely depending upon the thickness and/or the nature of the substrate 114. For example, the substrate 114 may be a thick paperboard with some compression ability, wherein the scoring process compresses the paperboard from the laminated side of the paperboard substrate 114 to create the indentation, while failing to create a protrusion in the non-laminated side of the substrate 114.

Figure 1B:
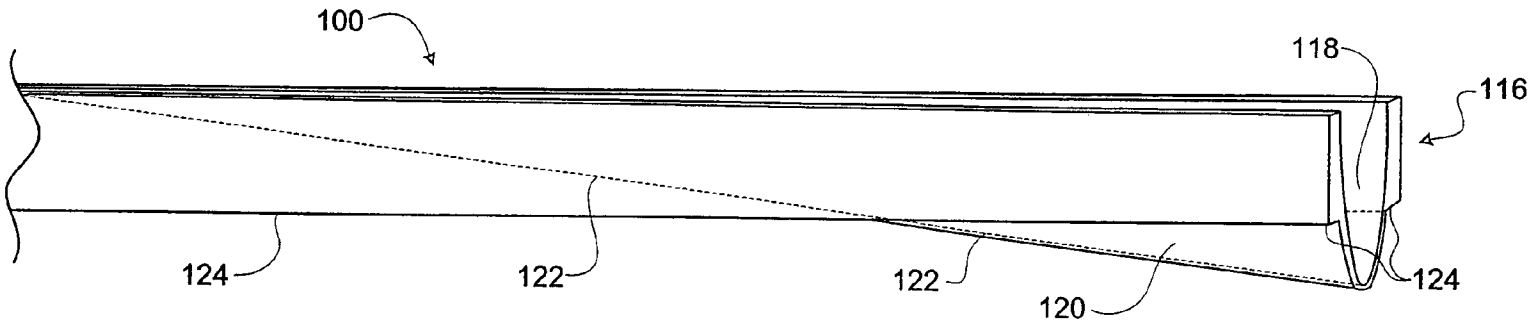
FIG. 1B is a perspective view of a cross-section of an exemplary embodiment of microwave packaging material with an indentation pattern of varying depth.

In an exemplary embodiment, the depth of an indentation line 116 may vary over the length of the indentation line 116 as depicted, for example, in FIG. 1B. A cross-section of microwave packaging material 100 according to the present invention is shown in FIG. 1B, wherein the bottom 122 of the concave portion 118 of the indentation line 116 is shallow at one end and increases in depth as it moves toward the exterior edge of the microwave packaging material 100. At the shallow end, the indentation line 116 does not cause a protrusion in the microwave packaging bottom 124. However, as the indentation line 116 grows deeper, the indentation line 116 begins to cause a protrusion from the microwave packaging bottom 124 and forms a convex portion 120 of the indentation line 116. This example illustrates the wide range of possibilities for depth configurations of indentation lines 116 in the microwave packaging material 100. As illustrated in FIG. 1A, the microwave packaging material 100 and the indentations 116 are configured so that the indentations are at least partially defined by the microwave interactive layer/susceptor, which in the exemplary embodiment includes the susceptor film 105 and the etched aluminum layer 104, and the integrity of the microwave interactive layer/susceptor is substantially maintained.

Figure 2:
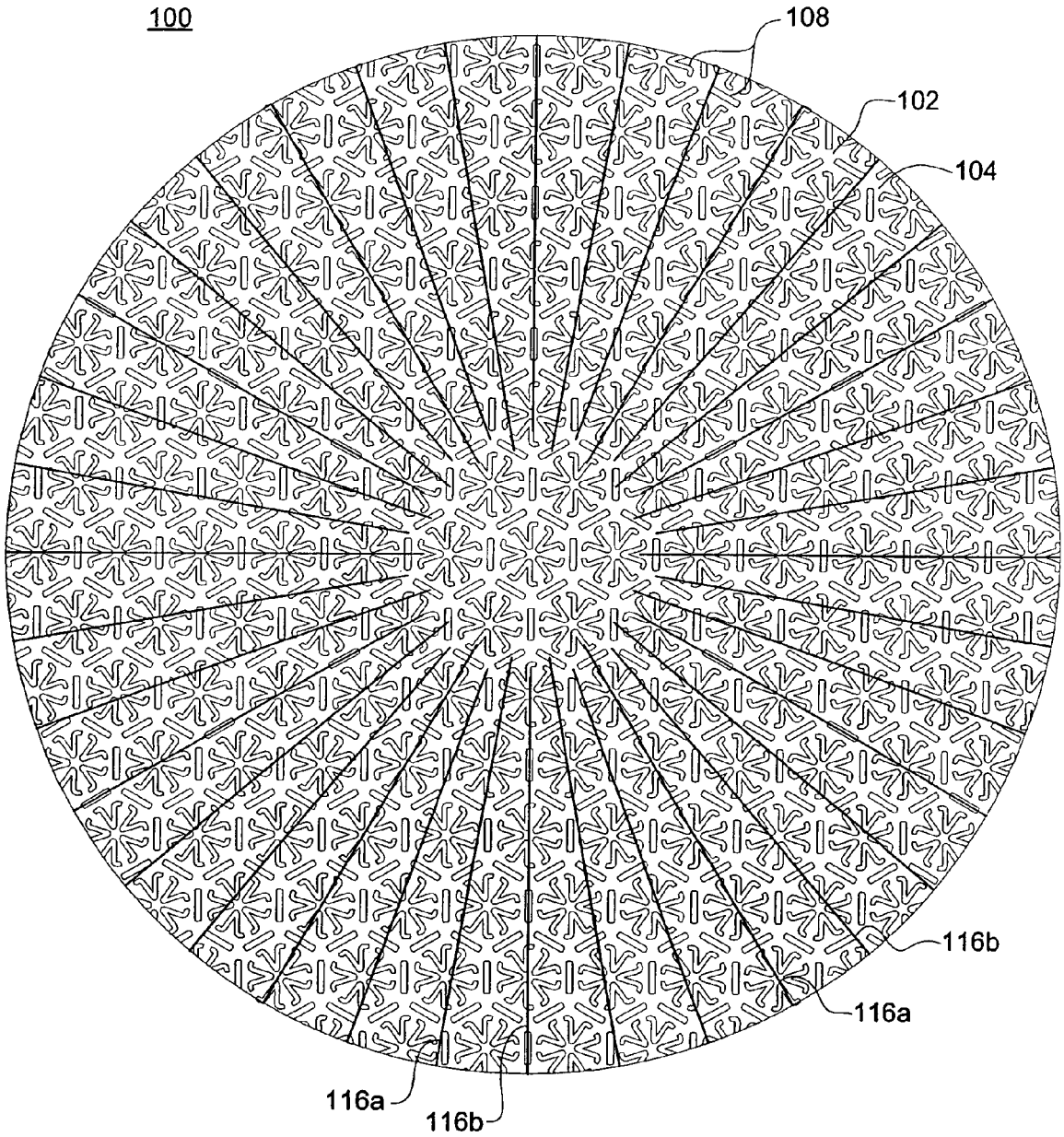
FIG. 2 is a top plan view of the exemplary embodiment of the microwave packaging material of FIG. 1 in a disk shape with an exemplary indentation pattern.

FIG. 2 depicts a plan view of a circular blank of the microwave packaging material 100 manufactured according to the exemplary process previously detailed. The polyester layer 102 is substantially transparent; thus the aluminum deposition layer 104 can be seen. Similarly, the aluminum deposition layer 104 is substantially thin such that the etched foil pattern 108 can likewise be seen from the polyester substrate 102 side of the microwave packaging material 100. An exemplary indentation pattern is depicted in FIG. 2 by indentation lines 116*a* and 116*b*. Indentation lines 116*a* and 116*b* form a uniform, radial array of indentations extending from near the center of the circular blank outward to the edges of the circular blank. Indentation lines 116*a* are slightly longer than indentation lines 116*b*.

The novel indentation lines 116*a* and 116*b*, and the other novel forms of indentation patterns disclosed herein, provide several important and distinct benefits to enhance the cooking of a food product in a package made from the microwave packaging material 100. The indentation patterns may work, for example, in three ways to increase the baking and browning capabilities of the microwave packaging material.

First, the indentation patterns may provide venting to channel moisture trapped beneath the food product. Depending upon the type of food product and the desired effect, the indentation patterns can be designed to variously channel moisture from one area of the food product to another, trap moisture in a certain area to prevent it from escaping, and channel the moisture completely away from the food product. Generally, the food product is placed upon the polyester substrate 102 side of the exemplary microwave packaging material 100. In one embodiment, the side of the polyester substrate 102 is the side that is scored; thus the concave indentation patterns 118 become channels for directing moisture trapped underneath the food product. In another embodiment, the indentation patterns may be scored from the side of the paperboard substrate 114, resulting in convex protrusion patterns in the side of the polyester substrate 102.

In this instance, such patterns may be designed to trap moisture in certain areas by creating a seal between the top of the protrusion and the bottom of the food product.

The type of food product to be heated and the desired cooking effect may dictate the indention patterns 116 and spacing between elements of the pattern. Greater or fewer indentation lines 116 may be scored depending upon such factors as, for example, the moisture content of the food product, the thickness of the food product, characteristics of the food product (e.g., fat content), and the surface area occupied by the food product. It may require some trial and error over time to determine the appropriate pattern for use with a particular food product and the particular portion size. For example, observations during cooking may determine locations where the moisture content is too high and the food product is soggy. Such an observation may indicate that a particular scoring pattern is necessary to channel moisture away from that area. Likewise, if upon observation an area of a food product is drying out during cooking, the indentation pattern may be designed to channel moisture to that area.

In order to increase the moisture venting capacity, the indention patterns may be made wider or deeper to accommodate more flow volume. Forming a deeper indention pattern also increases the gap between the microwave packaging material and either the food product or the cooking platform in a microwave oven, and thereby increases the insulation and microwave propagation benefits. There is a potential downside, however, to increasing the width or depth of the indentation patterns 116 if the microwave interactive layer includes a susceptor film 105. In this case the susceptor film 105 in the areas of the indentation patterns 116 will be separated from the food product for the width of the indentation pattern 116 and at a distance of the depth of the indentation pattern 116. In these areas the performance of the microwave packaging material 100 as a susceptor may not be as great because of the air or moisture in the channels formed by the indentation patterns 116 that act as insulators.

Second, the convex protrusions in the paperboard substrate caused by the indentation patterns 116 cause the microwave packaging material 100 underneath a food product to be slightly elevated above the glass tray, or other cooking platform, in the base of a microwave. In normal microwave operation, the glass tray acts as a large heat sink, absorbing much of the heat generated by microwave interactive materials, for example, the susceptor film 105, and thereby lessening the ability of the microwave packaging material 100 to augment the heating and browning of the food product. The convex protrusions from the indentation patterns lessen the heat sinking effect of the glass tray by raising the microwave packaging material 100 above the glass tray, thereby providing an air gap for insulation. The layer of air interposed between the microwave packaging material 100 and the glass tray provides a higher degree of insulation than provided merely by the paperboard substrate 114, preventing heat loss to the glass tray and enabling more heat absorption by the food product.

Third, elevating the base of the microwave packaging material 100 further allows more microwave radiation to reach the food product, and thereby increases the cooking ability of the microwave oven. The slight gap caused by the convex protrusions in the paperboard substrate 114 allows additional incident microwave radiation to propagate underneath the microwave packaging material 100 and be absorbed by the food product or by microwave interactive materials in the microwave packaging material 100 that augment the heating process.

FIGS. 3-24 depict various exemplary embodiments of indentation patterns that may be used according to the present invention. These exemplary embodiments are by no means exhaustive of the various types and configurations of indentation patterns that may be used to achieve the benefits of the present invention. Each of the indentation patterns is depicted in a configuration for use with a disk-shaped microwave packaging blank, for example, for cooking a pizza, for convenience of this disclosure. However, this should not be perceived as limiting of the shapes and configurations of microwave packaging materials with which these exemplary types of indentation patterns, as well as other indentation patterns according to this invention may be used. For example, the microwave packaging may be in the form of a tray, dish, or similar container with sidewalls. In this embodiment, the venting aspect of the invention may allow the moisture to vent to the sidewalls of the container where it may escape from under the food product in the container up the sidewalls of the container. Such a container with sidewalls may be of any shape, for example, a round pie pan, a rectangular baking tray, or an oval casserole dish. In addition, the venting patterns disclosed herein may similarly be applied to the sidewalls of such containers.

Figure 3:
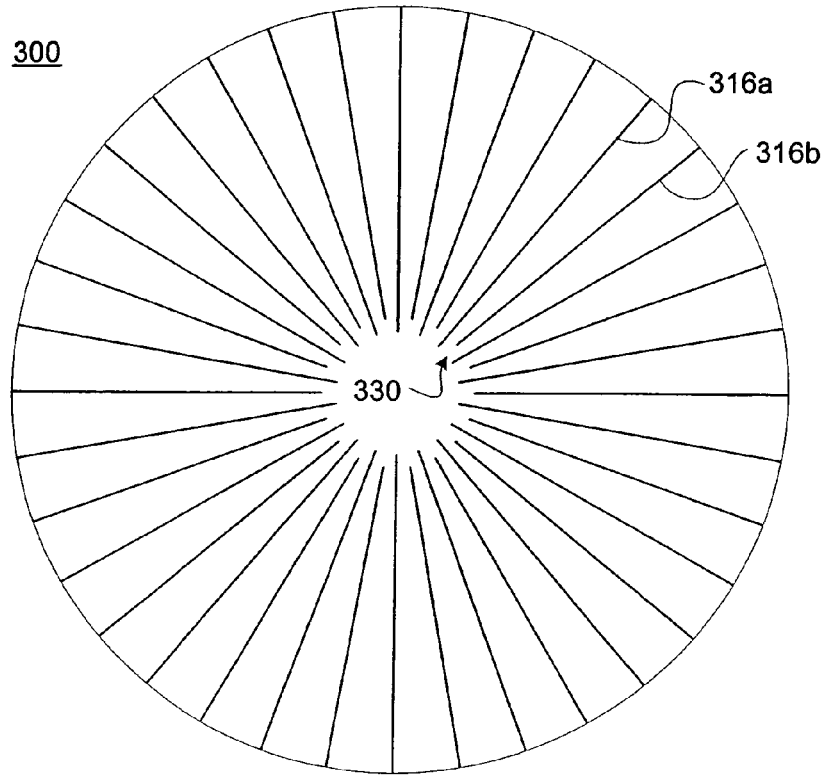
FIG. 3 is a top plan view of the exemplary indentation pattern of FIG. 2 for use with disk-shaped microwave packaging.

FIG. 3 depicts more clearly the indentation pattern of FIG. 2, without depicting the clutter of the underlying microwave interactive patterns on the microwave packaging material 300. Again, the indentation patterns of FIG. 3 are compose of two lengths of indentation lines 316*a* and 316*b* forming a uniform, radial array of indentations extending from near the center 330 of the circular blank outward to the edges of the circular blank. The venting goal of this indentation pattern is to expel moisture from underneath the food product by channeling the moisture to the edge of the microwave packaging material 300. Indentation lines 316*a* are slightly longer than indentation lines 316*b*. The indentation lines 316*b* are deliberately made shorter to maintain the integrity of the microwave packaging material 300. If both sets of indentation lines were coterminous at the same radial length from the center of the disk, the ends of the indentation lines 316*a* and 316*b* in the center area 330 would be spaced closely adjacent resulting in a ringed scores around the center area 330 of the disk, thereby weakening the center area 330 and making it susceptible to tearing.

Figure 4A:
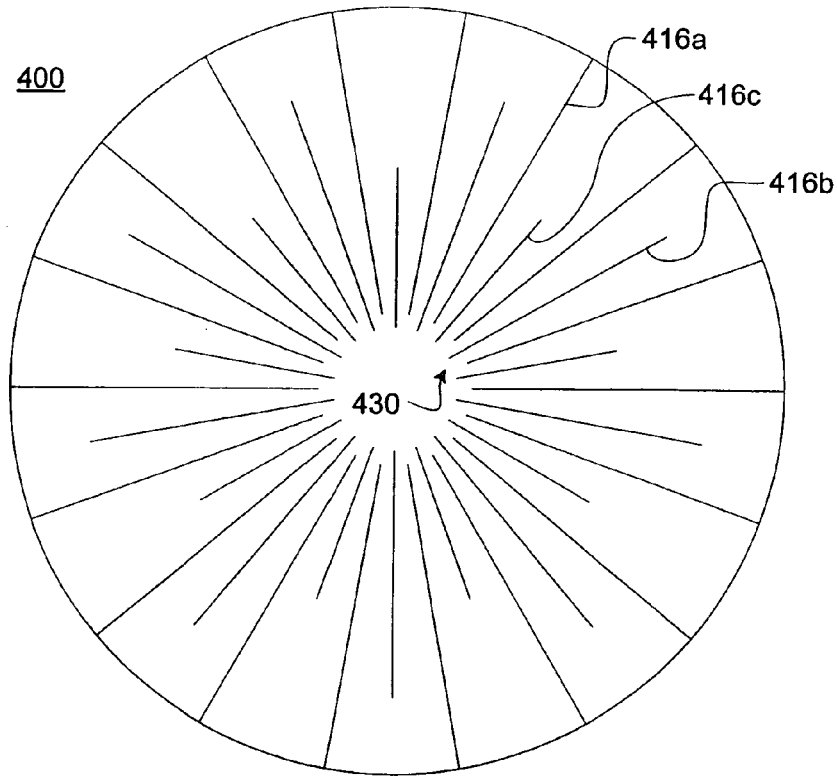
FIG. 4A is a top plan view of a second exemplary indentation pattern for use with disk-shaped microwave packaging.

FIG. 4A depicts a second indentation pattern on a microwave packaging material 400. The second indentation pattern is similarly composed of a uniform array of radial indentation lines. In this instance, indentation lines 416*a* extend from near the center area 430 to the peripheral edge of the microwave packaging material 400; indentation lines 416*b* extend from near the center area 430 to near a peripheral margin of the microwave packaging material 400; and indentation lines 416*c* extend from near the center area 430 to approximately midway between the center area 430 and the peripheral edge of the microwave packaging material 400. In this second indention pattern embodiment, venting is provided in one aspect via indentation lines 416*a* to expel moisture from underneath the food product by channeling the moisture to the edge of the microwave packaging material 400. Indentation lines 416*b* and 416*c* provide for channeling moisture from one area underneath the food product to another.

Figure 4B:
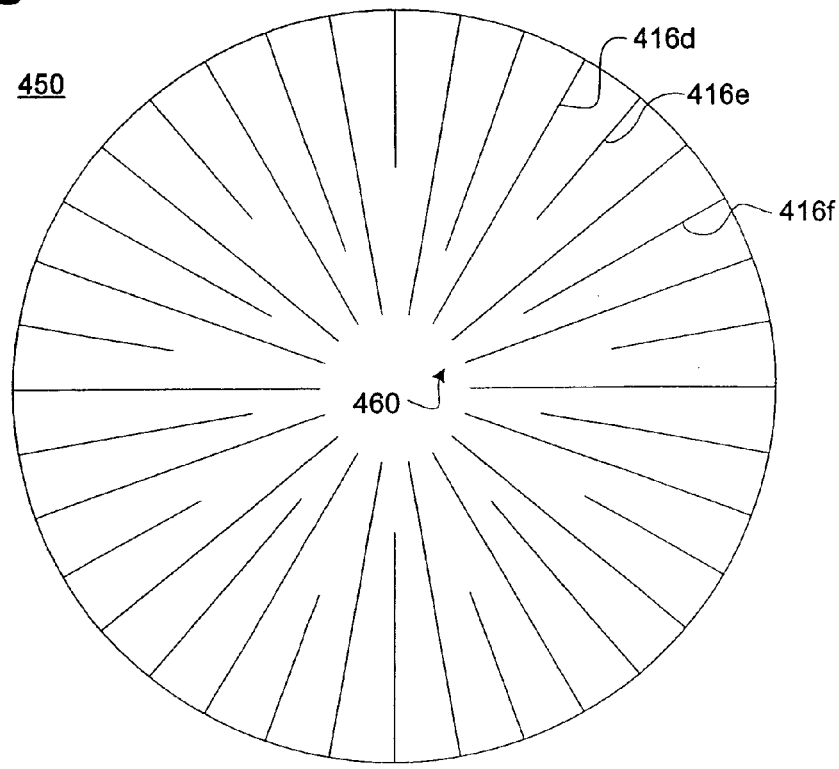
FIG. 4B is a top plan view of a third exemplary indentation pattern for use with disk-shaped microwave packaging.

FIG. 4B depicts a third indentation pattern for microwave packaging material 450 very similar to the pattern of FIG. 4A. Instead of the shorter indentation lines 416*e* and 416*f* merely channeling moisture from underneath one area of the food product to another, indentation lines 416*e* and 416*f*, as well as indentation lines 416*d*, each extend to the peripheral edge of the microwave packaging material 450 to expel moisture. In FIG. 4B, indentation lines 416*d* extend from near the center area 460 to the peripheral edge of the microwave packaging material 450; indentation lines 416*e* extend from approximately midway between the center area 460 to the peripheral edge of the microwave packaging material 450; and indentation lines 416*f* extend from near the center area 460 to near a peripheral margin of the microwave packaging material 450. In this manner, channels for moisture expulsion are generally equally distributed among all areas underneath the food product.

Figure 5:
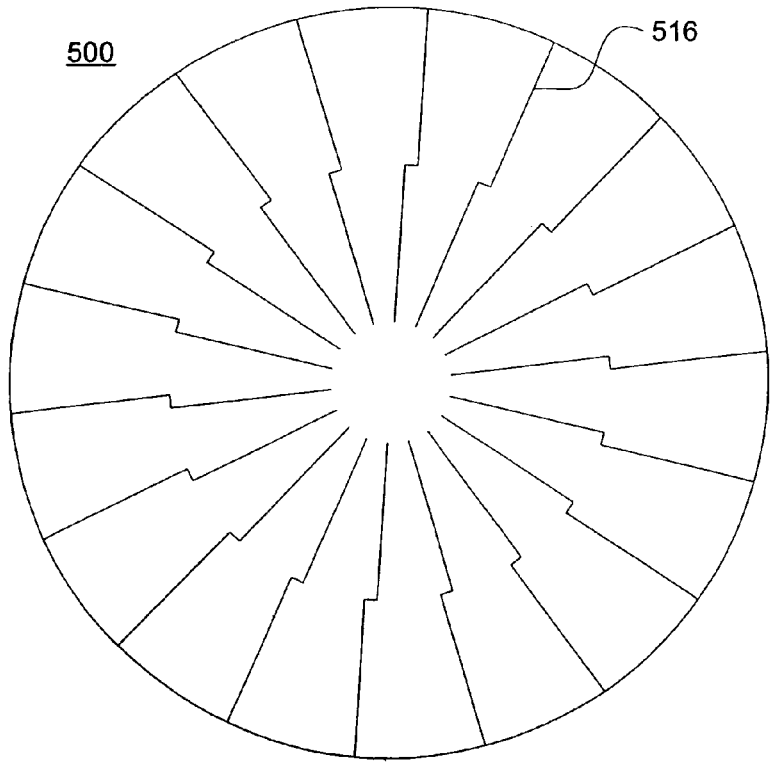
FIG. 5 is a top plan view of a fourth exemplary indentation pattern for use with disk-shaped microwave packaging.

FIG. 5 depicts a fourth embodiment of an indentation pattern on a microwave packaging material 500. This indentation pattern is composed of a uniform array of generally radial indentation lines 516. The indentation lines 516 extend from near the center to the peripheral edge of the microwave packaging material 500. Each of the indentation lines 516 has a single zigzag about midway along the indentation line 516, perpendicular to the radial direction. This zigzag pattern may provide a moderating effect upon the rate of moisture transfer from one area to another, or from underneath the food product, due to the longer path length. Controlling the moisture transfer rate may be important depending upon the type of food product and the cooking outcome desired. For example, if the food product should retain some moisture, but the cooking process releases more than desired, longer path length indentation lines 516 may be helpful in expelling the excess moisture without drying out the food product.

Figure 6:
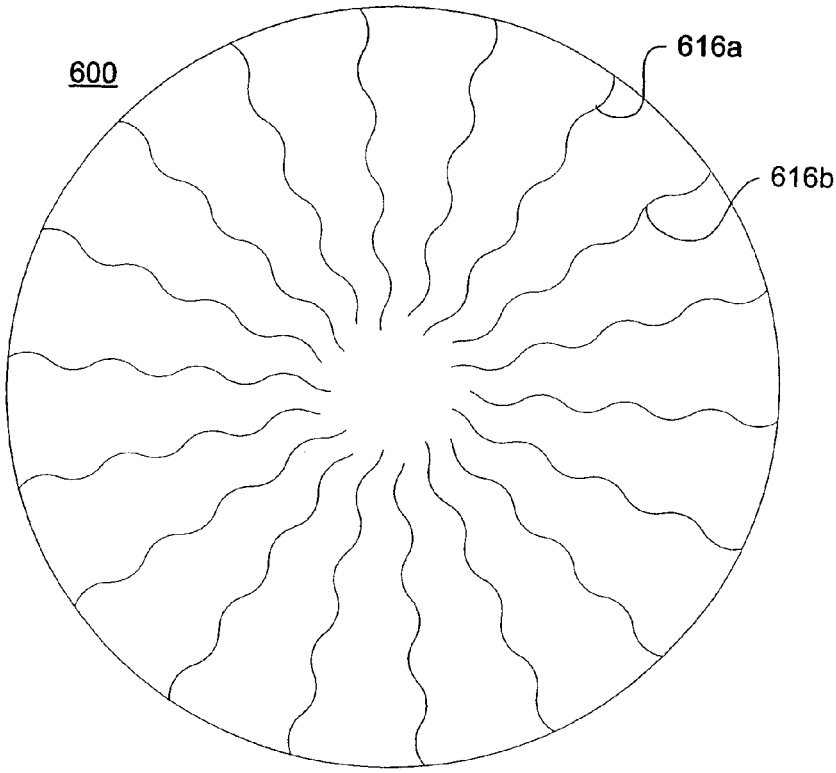
FIG. 6 is a top plan view of a fifth exemplary indentation pattern for use with disk-shaped microwave packaging.

FIG. 6 depicts a fifth indention pattern for use with microwave packaging material 600. In this embodiment the indentation pattern is composed of an array of curved or sinusoidal, radial indentation lines 616*a* and 616*b*. A first set of indentation lines 616*a* is longer than a second set of indentation lines 616*b* to prevent potential weakening of the center area of the microwave packaging material 600 as discussed with reference to FIG. 3. Similar to the discussion of FIG. 5, such sinusoidal indention lines 616*a* and 616*b* can help control the moisture transfer rate because of the longer path length provided.

Figure 7:
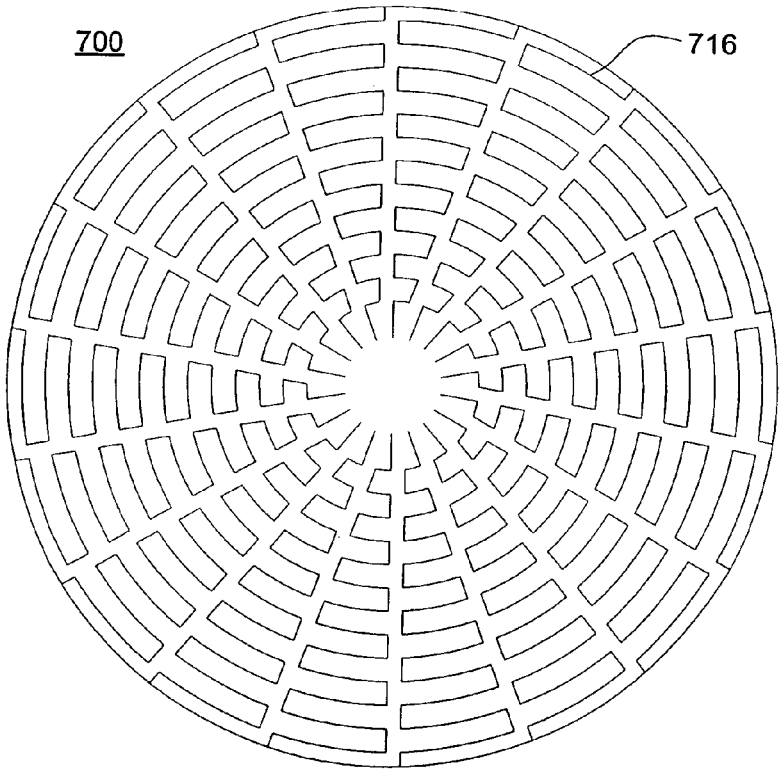
FIG. 7 is a top plan view of a sixth exemplary indentation pattern for use with disk-shaped microwave packaging.

FIG. 7 depicts a sixth embodiment of an indentation pattern, for use with microwave packaging material 700. The indentation pattern of this embodiment is composed of an array of radially-oriented indentation lines 716 of a stair-step, zigzag pattern. This pattern may slow the rate of moisture venting substantially as a result of the extremely long path lengths of the indentation lines 716. Additionally, because of the stair-step, zigzag pattern, the indention lines travel under a significant amount of the base surface area of a food product, and may thereby help to even the moisture distribution throughout the food product, preventing overly soggy or overly dry areas.

Figure 8:
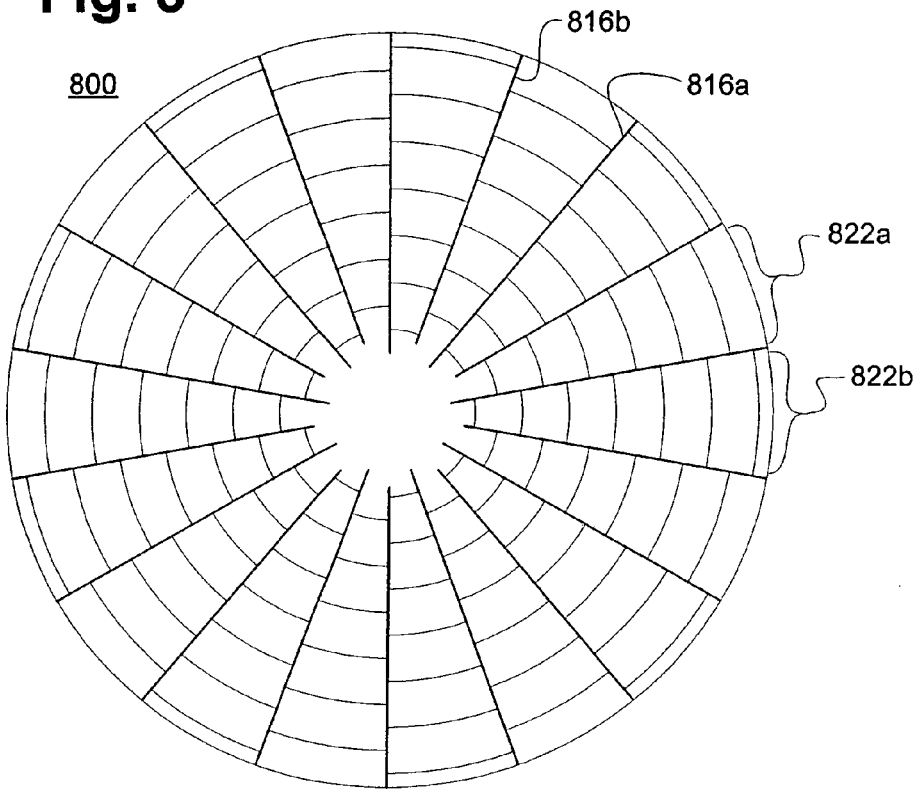
FIG. 8 is a top plan view of a seventh exemplary indentation pattern for use with disk-shaped microwave packaging.

FIG. 8 depicts a seventh embodiment of an indentation pattern for use with microwave packaging material 800. In this embodiment, an array of uniform, radial indentation lines 816*a* and 816*b*, as described with respect to FIG. 3, is augmented by concentric, segmented arc indentations 822*a* and 822*b* perpendicular to the radial direction and joining adjacent indentation lines 816*a* and 816*b* at various points along the length of the indentation lines 816*a* and 816*b*. Each of the sets of radial indentation lines 816*a* and 816*b* and related segmented arc indentations 822*a* or 822*b* may be viewed generally as a sector, wherein each of the sectors shares a common indentation line 816*a* or 816*b*. This exemplary pattern may provide several moisture transfer effects in combination. First, the indentation lines 816*a* and 816*b* may expel moisture from underneath a food product by channeling the moisture to the peripheral edge of the microwave packaging material 800. Second, the arc indentations 822*a* and 822*b* provide alternate channels for the moisture to travel along, providing both a control over the rate of moisture transfer and an even distribution of moisture underneath the food product.

Figure 9:
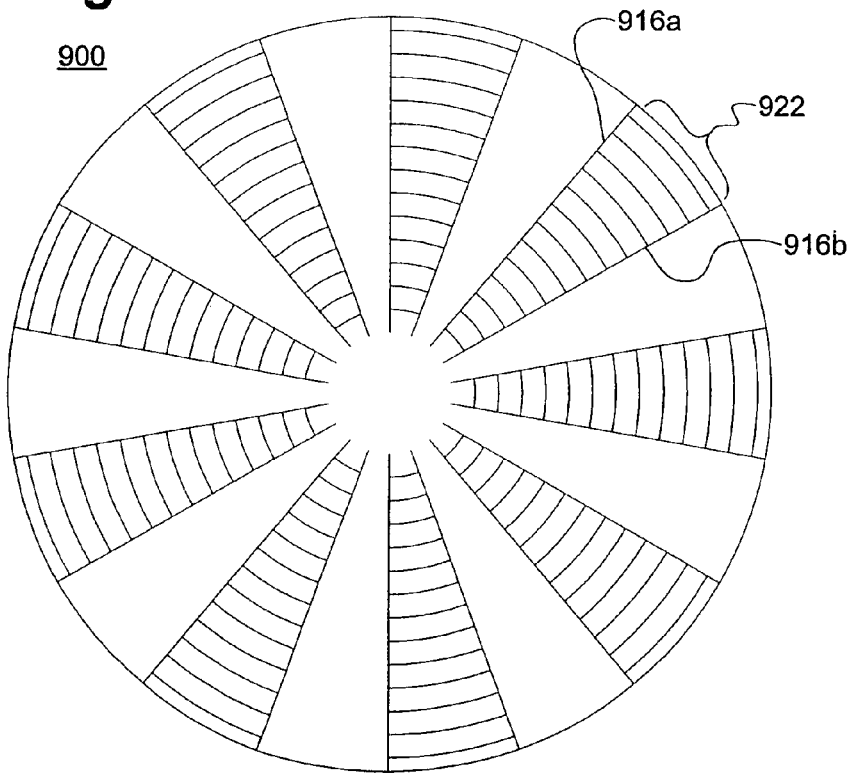
FIG. 9 is a top plan view of an eighth exemplary indentation pattern for use with disk-shaped microwave packaging.

FIG. 9 depicts an eighth indentation pattern for use with microwave packaging material 900. This indentation pattern is a variation of the pattern of FIG. 8. In this exemplary embodiment, an array of uniform, radial indentation lines 916*a* and 916*b*, joined in separate pairs by concentric, segmented arc indentations 922 perpendicular to the radial direction at various points along the length of paired indentation lines 916*a* and 916*b*. Each of the sets of radial indentation lines 916*a* and 916*b* and related segmented arc indentations 922 may be viewed generally as a sector, and each sector is spaced apart from an adjacent sector. This indentation pattern may result in similar moisture venting effects as the pattern of FIG. 8; however, the moisture distribution ability of paired indentation lines 916*a* and 916*b* and arc indentations 922 is not as broad due to the areas between indentation line pairs 916*a* and 916*b* void of any indentions for channeling moisture.

Figure 10:
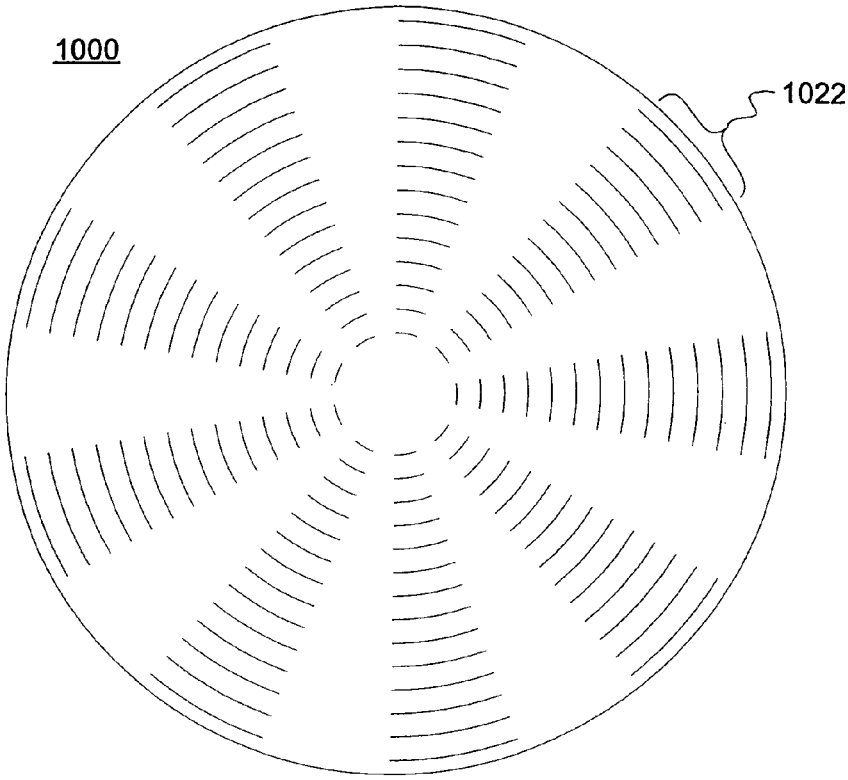
FIG. 10 is a top plan view of a ninth exemplary indentation pattern for use with disk-shaped microwave packaging.

FIG. 10 depicts a ninth embodiment of an indentation pattern that is a variation of the indentation patterns of FIGS. 8 and 9. In this embodiment, the pattern on the microwave packaging material 1000 is an array of radial sets of concentric, segmented arc indentations 1022, perpendicular to and spaced apart along the radial direction. Each of the radial sets of segmented arc indentations 1022 may be viewed as a sector, and each sector is spaced apart from an adjacent sector. The primary venting property of such an indentation pattern may be to distribute moisture between various areas underneath the food product.

Figure 11:
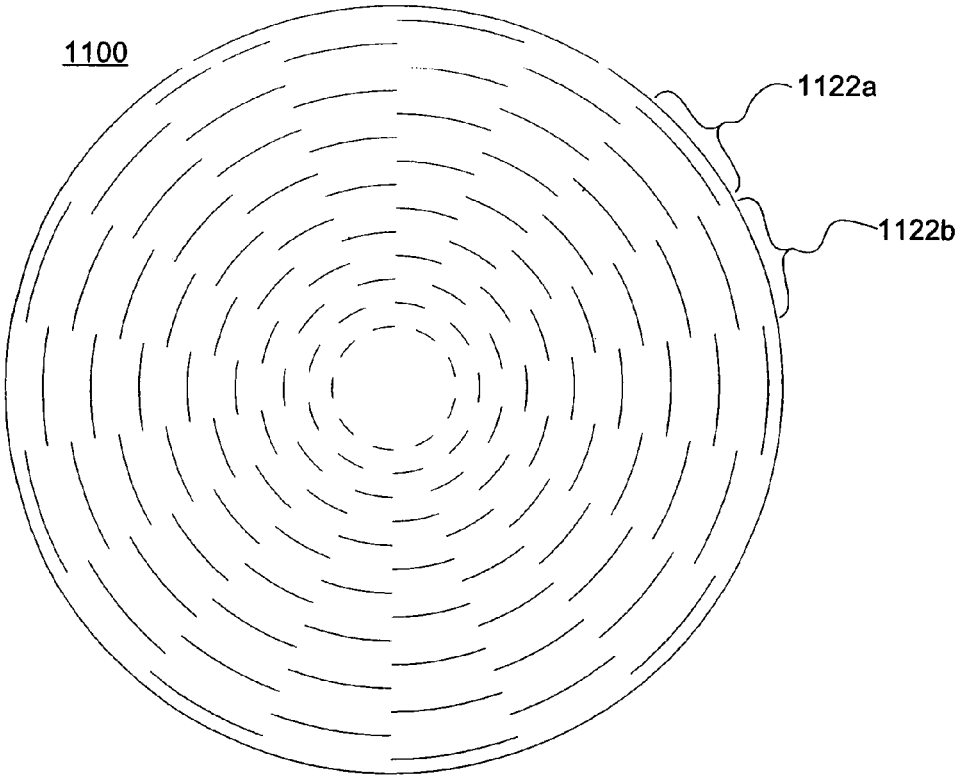
FIG. 11 is a top plan view of a tenth exemplary indentation pattern for use with disk-shaped microwave packaging.

FIG. 11 is a tenth embodiment of an exemplary indentation pattern on a microwave packaging material 1100. It is also a variation of the design of the indentation pattern of FIG. 8. In this embodiment, the pattern on the microwave packaging material 1100 is an array of radial sets of concentric, segmented arc indentations 1122*a* and 1122*b*, perpendicular to and spaced apart along the radial direction. Each set of segmented arc indentations 1122*a* or 1122*b* may generally be viewed as a sector, and each sector is adjacent to another sector. Unlike the segmented arc indentations of FIG. 10, these sets of segmented arc indentations 1122*a* and 1122*b* are evenly distributed concentrically and axially from the center and around the entire area of the microwave packaging material 1100. In the depiction of FIG. 11, sets of segmented arc indentations may generally be viewed as adjacent sectors. Here again, the venting provided by the segmented arc indentations 1122*a* and 1122*b* may primarily be to distribute moisture evenly between various areas underneath the food product.

Figure 12:
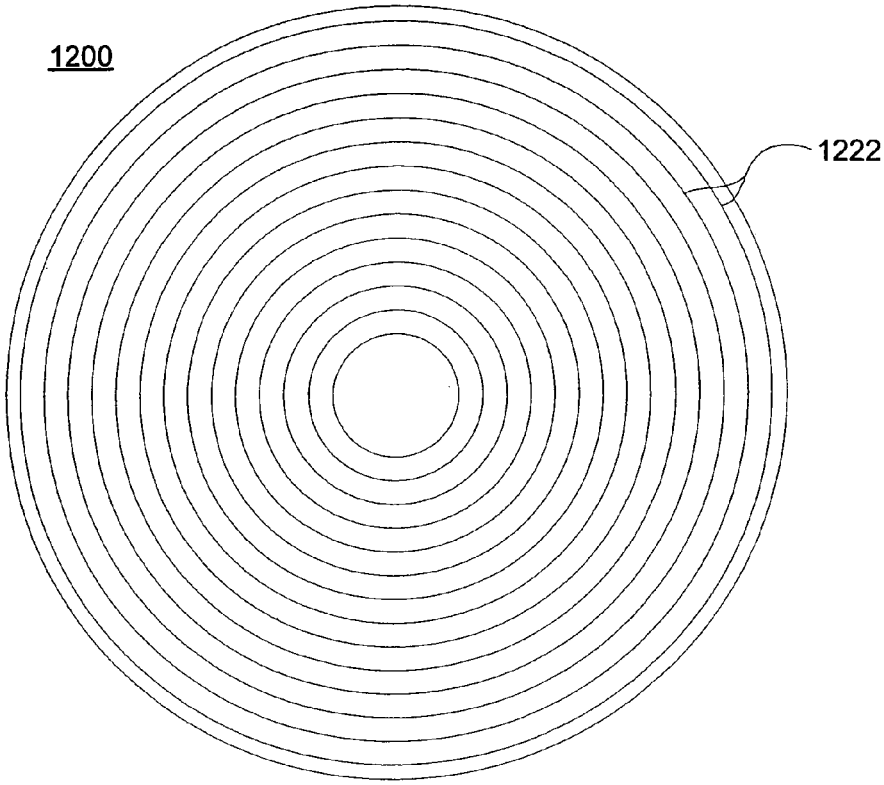
FIG. 12 is a top plan view of an eleventh exemplary indentation pattern for use with disk-shaped microwave packaging.

FIG. 12 is an eleventh embodiment of an indentation pattern for use with microwave packaging material 1200. This example depicts the indentation pattern as a series of concentric circular indentation lines 1222, spaced apart radially, and extending from the center area of the microwave packaging material 1200 to the peripheral margin of the microwave packaging material 1200. When a food product rests upon the side of the microwave packaging material 1200 with concave indentation lines 1222, the exemplary pattern of FIG. 12 may help distribute moisture evenly to most areas underneath the food product without expelling any of the moisture. If instead, the food product rests upon the convex protrusion of the indentation lines 1222, the microwave packaging material 1200 may be used to actively trap moisture and prevent it from migrating to the peripheral edge of the microwave packaging material 1200 where it would be released.

Figure 13:
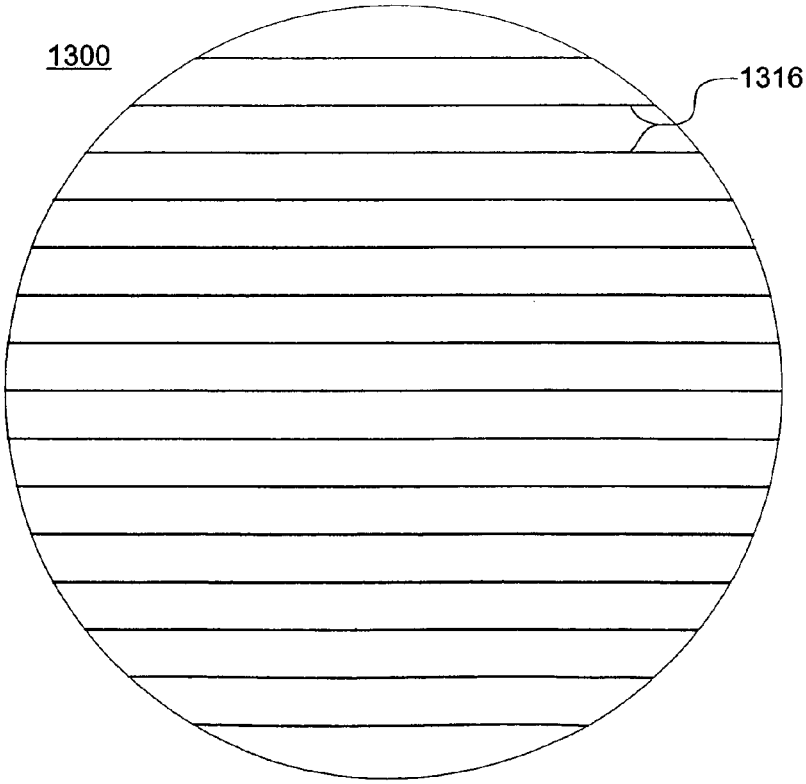
FIG. 13 is a top plan view of a twelfth exemplary indentation pattern for use with disk-shaped microwave packaging.

FIG. 13 depicts a twelfth exemplary embodiment of a possible indentation pattern for use with microwave packaging material 1300. In this embodiment, a series of indentation lines 1316 is formed in parallel and spaced apart evenly across a dimension of the microwave packaging material. This configuration of indentation lines 1316 may provide both moisture transfer from one side of the microwave packaging material 1300 to another, as well as moisture expulsion once the moisture reaches a peripheral edge of the microwave packaging material 1300.

Figure 14:
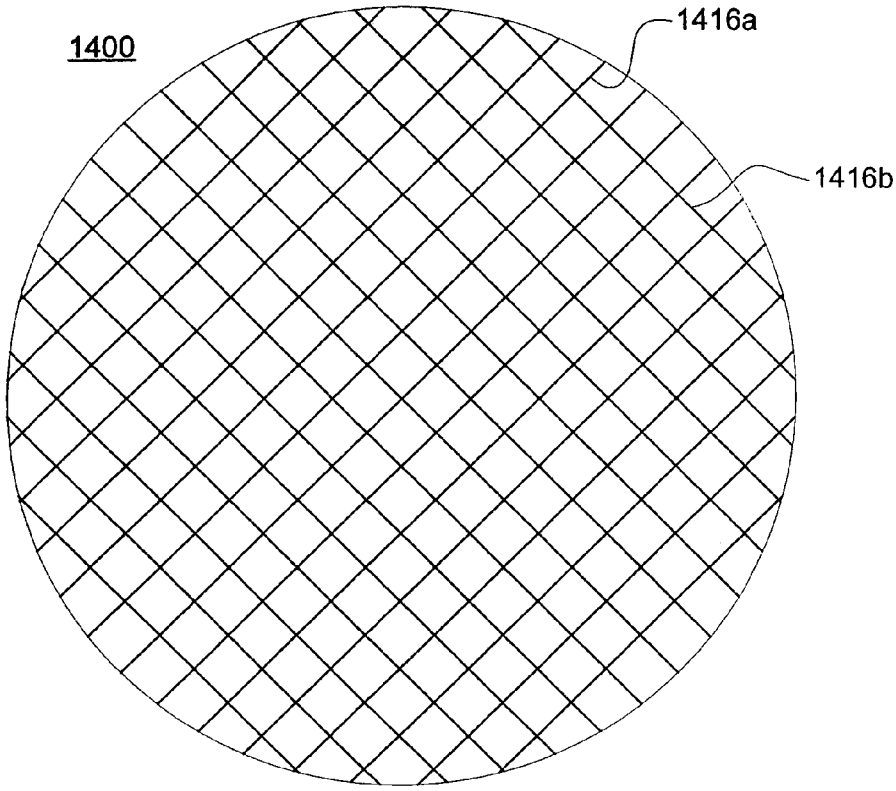
FIG. 14 is a top plan view of a thirteenth exemplary indentation pattern for use with disk-shaped microwave packaging.

FIG. 14 depicts a thirteenth exemplary embodiment of a possible indentation pattern for use with microwave packaging material 1400. In this embodiment, a first series of indentation lines 1416*a* is formed in parallel and spaced apart evenly across a first dimension of the microwave packaging material. A second series of indentation lines 1416*b* is also formed in parallel and spaced apart evenly across a second dimension of the microwave packaging material, whereby the second series of indentation lines 1416*b* intersects the first series of indentation lines 1416*a*. In this exemplary embodiment, the first set of indentation lines 1416*a* is perpendicular to the second set of indentation lines 1416*b*, although this need not be the case. This configuration of indentation lines 1416*a* and 1416*b* may provide both moisture transfer from one side of the microwave packaging material 1400 to another, as well as moisture expulsion once the moisture reaches a peripheral edge of the microwave packaging material 1400. Because the sets of indentation lines 1416*a* and 1416*b* intersect at multiple locations, the moisture transfer may be more evenly allocated in this embodiment and the rate of moisture transfer or expulsion may be reduced depending on the path the moisture follows.

Figure 15A:
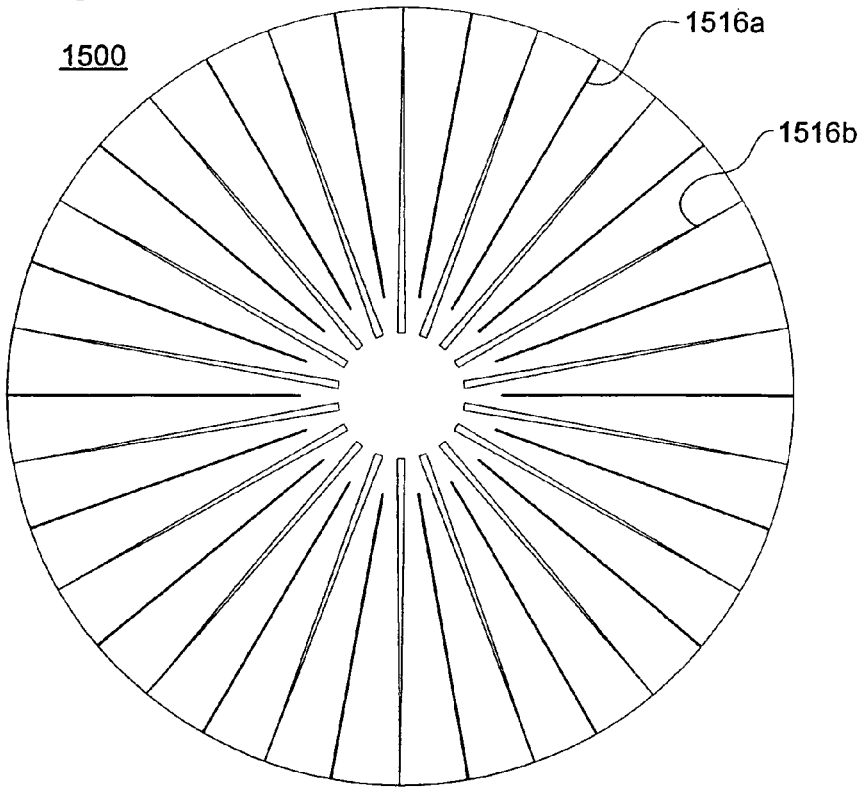
FIG. 15A is a top plan view of a fourteenth exemplary indentation pattern for use with disk-shaped microwave packaging.

FIG. 15A depicts a fourteenth embodiment of an indentation pattern similar to the indentation pattern of FIG. 3 with a first set of indentation lines 1516*a* and a second set of indentation lines 1516*b* extending radially from near the center of the microwave packaging material 1500 to the peripheral edge of the microwave packaging material 1500. However, in FIG. 15A, each of the second set of indentation lines 1516*b* is wider near the center of the microwave packaging material 1500 and tapers as the indention lines 1516*b* approach the peripheral edge of the microwave packaging material 1500. Such a wider area in the indentation lines 1516*b* may allow for the collection of larger amounts of moisture from a more moist area to be transferred to another, drier area, and/or vented away. The selection of widths for the indentation lines 1516*a* and 1516*b* should be made based upon the type of food product to be cooked, its moisture content, and the desired cooking result, to determine the capacity needed to adequately vent moisture.

Figure 15B:
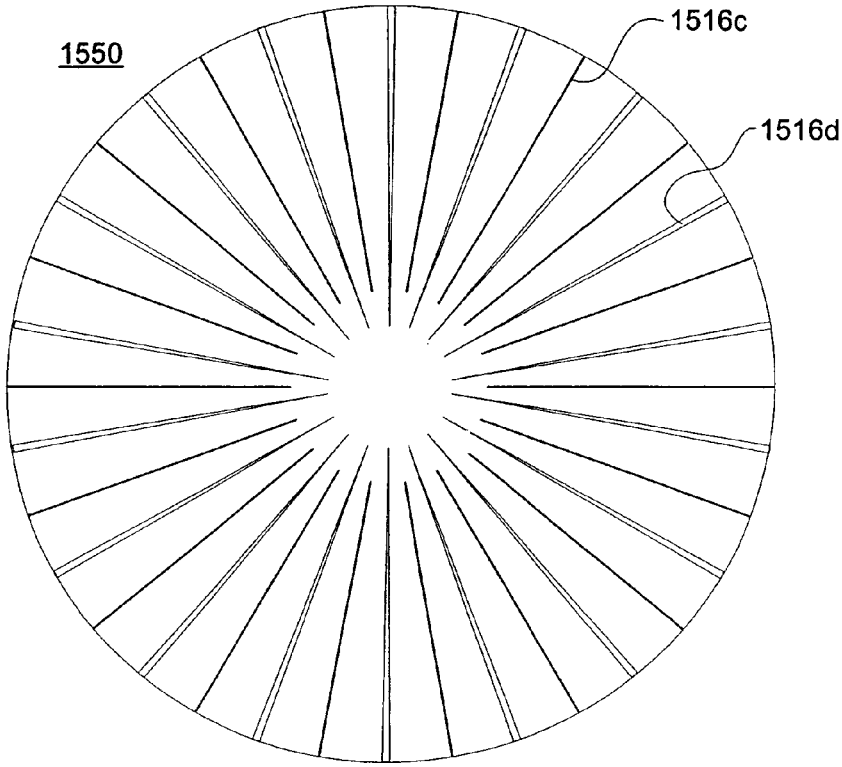
FIG. 15B is a top plan view of a fifteenth exemplary indentation pattern for use with disk-shaped microwave packaging.

FIG. 15B shows a fifteenth embodiment of an indentation pattern that reverses the tapering indentation lines 1516*b* of FIG. 15A. In FIG. 15B, the first set of indention lines 1516*c* is similar to the indentation lines 1516*a* of FIG. 15A and extend radially from near the center of the microwave packaging material 1550 to the peripheral edge of the microwave packaging material 1550. However, each of the second set of indentation lines 1516*d* is narrow near the center of the microwave packaging material 1550 and widens as the indention lines 1516*d* approach the peripheral edge of the microwave packaging material 1550. The widening area in the indentation lines 1516*d* may provide increasing capacity for the collection of compounding amounts of moisture as the indentation lines 1516*d* vent the moisture from the internal areas under the food product to be expelled at the peripheral edge of the microwave packaging material 1550. The selection of widths for the indentation lines 1516*c* and 1516*d* should be made based upon the type of food product to be cooked, its moisture content, and the desired cooking result, to determine the capacity needed to adequately vent moisture.

Figure 16:
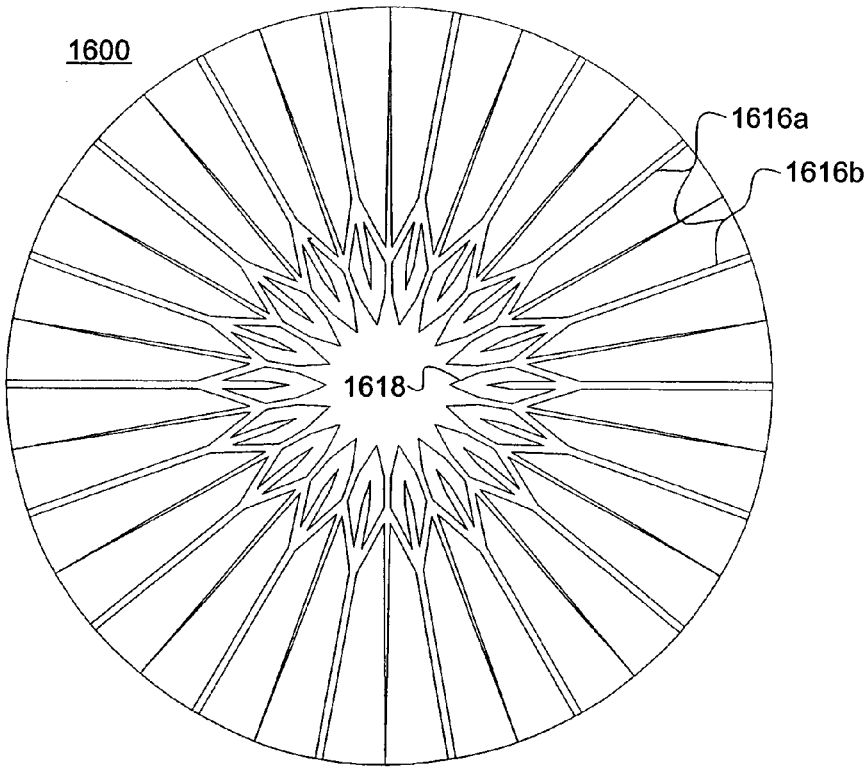
FIG. 16 is a top plan view of a sixteenth exemplary indentation pattern for use with disk-shaped microwave packaging.

FIG. 16 depicts a sixteenth embodiment of an exemplary indentation pattern for use with microwave packaging material 1600. The indentation pattern of FIG. 16 is considerably more complex than the previous patterns discussed and provides a good example of the breadth of pattern designs that may be used to provide moisture venting, reduce heat sink effects, and/or increase microwave propagation under the food product. Each indentation line 1616*a* starts at a first point along the peripheral edge of the microwave packaging material 1600, travels toward the center of the microwave packaging material 1600, and returns to the peripheral edge of the microwave packaging material 1600 at a second point spaced apart from the first point. Each indentation line 1616*b* starts at the second point of an adjacent indentation line 1616*a*, also travels toward the center of the microwave packaging material 1600, and returns to the peripheral edge of the microwave packaging material 1600 at a third point spaced apart from the second point and also spaced apart from an adjacent first point of a second adjacent indentation line 1616*a*. Note: in this embodiment, indentation lines 1616*a* and 1616*b* are merely thin score lines that happen to define complex patterns. The areas between indentation lines 1616*a* and 1616*b* are not wide and tapering indented areas such as the indentation lines 1516*b* and 1516*d* of FIGS. 15A and 15B. A third set of indentation lines 1618, which form clam shapes in this embodiment, is also arrayed around the center of the microwave packaging material 1600.

Figure 17:
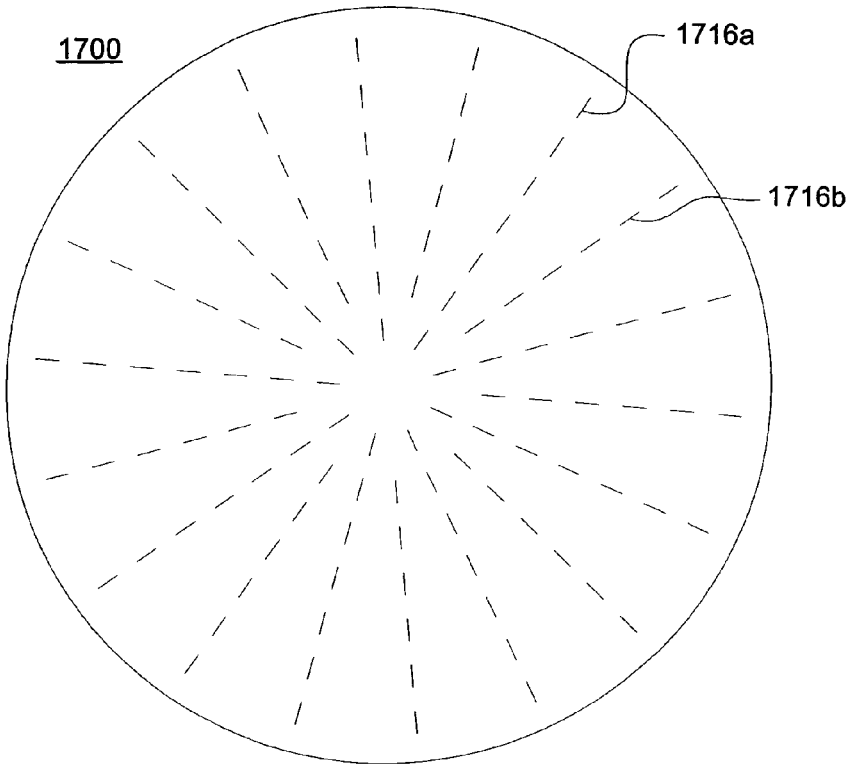
FIG. 17 is a top plan view of a seventeenth exemplary indentation pattern for use with disk-shaped microwave packaging.

FIG. 17 depicts a seventeenth exemplary indentation pattern in a microwave packaging material 1700. In this embodiment, the indentation pattern is again similar to that of FIG. 3, but the indentation lines are segmented. The first set of segmented radial indentation lines 1716*a* extends from near the center of the microwave packaging material 1700 to the peripheral margin of the microwave packaging material. The second set of segmented radial indentation lines 1716*b* begins further from the center of the microwave packaging material 1700 and extends to the peripheral margin of the microwave packaging material. With this configuration, the flow rate of moisture from the interior area of the microwave packaging material underneath the food to the peripheral margin may be significantly slower than previous exemplary designs. However, the segmented indentation lines 1716*a* and 1716*b* do provide channels that, while interrupted, may guide moisture from underneath the food product for expulsion at the margin.

While the venting properties of each of these exemplary indention pattern embodiments have been described in some detail, the indentation patterns may likewise produce benefits of insulation from the heat sink properties of microwave oven platforms and the improved opportunity for incident microwave radiation to propagate under the microwave packaging material and thus heat the food product. Each of these benefits of venting, insulation, and increased microwave propagation may be achieved, either individually, or in combination, in pairs or in total, through the appropriate choice of indentation pattern according to the present invention.

Figure 18:
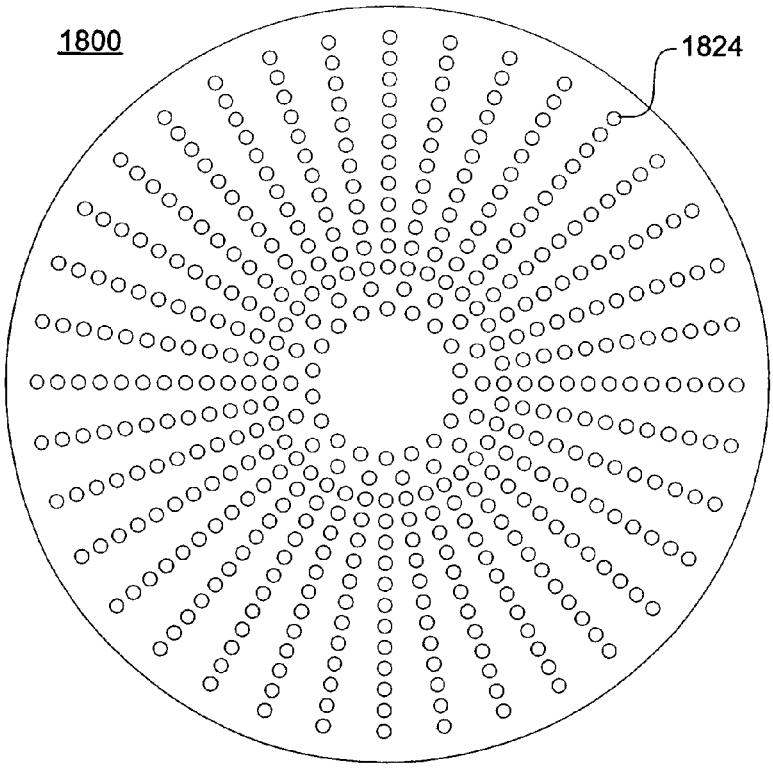
FIG. 18 is a top plan view of an eighteenth exemplary indentation pattern for use with disk-shaped microwave packaging.
Figure 19:
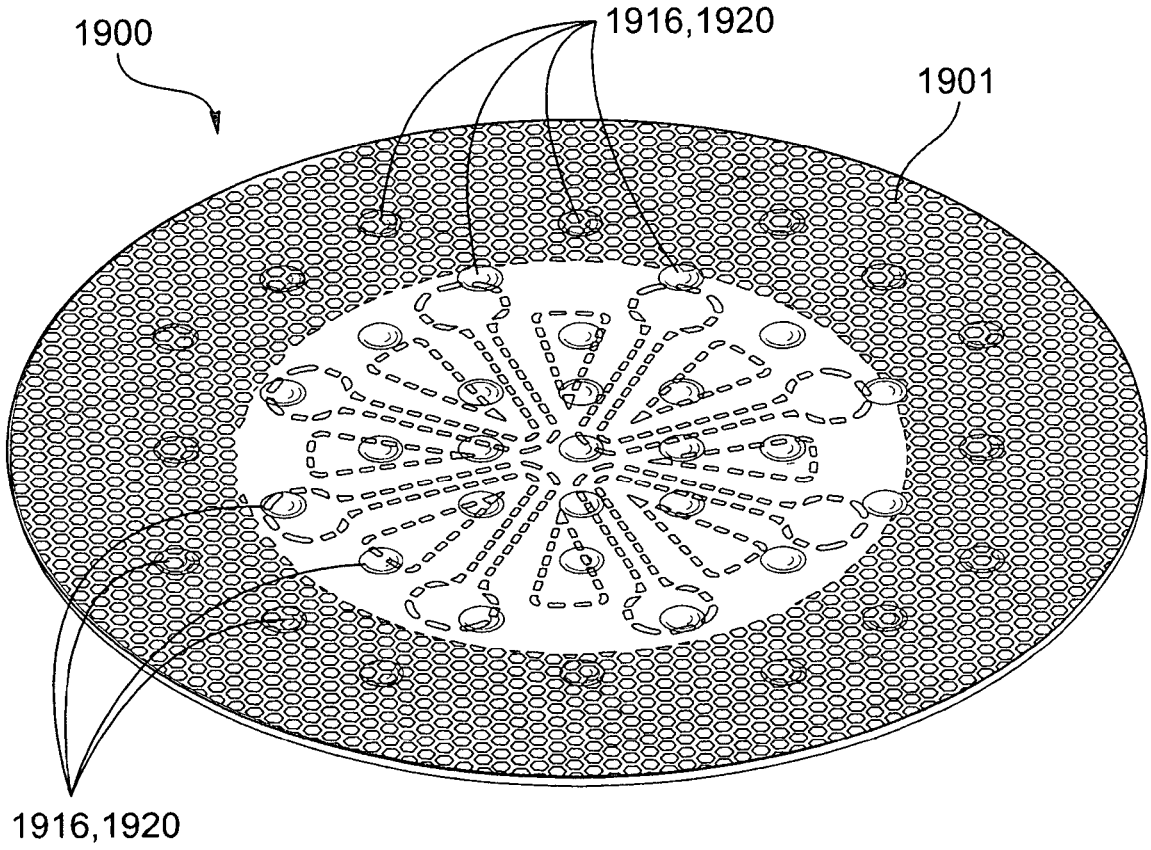
FIG. 19 is a schematic perspective view of a microwave packaging material with an indentation pattern in accordance with another embodiment of the present invention.
Figure 20:
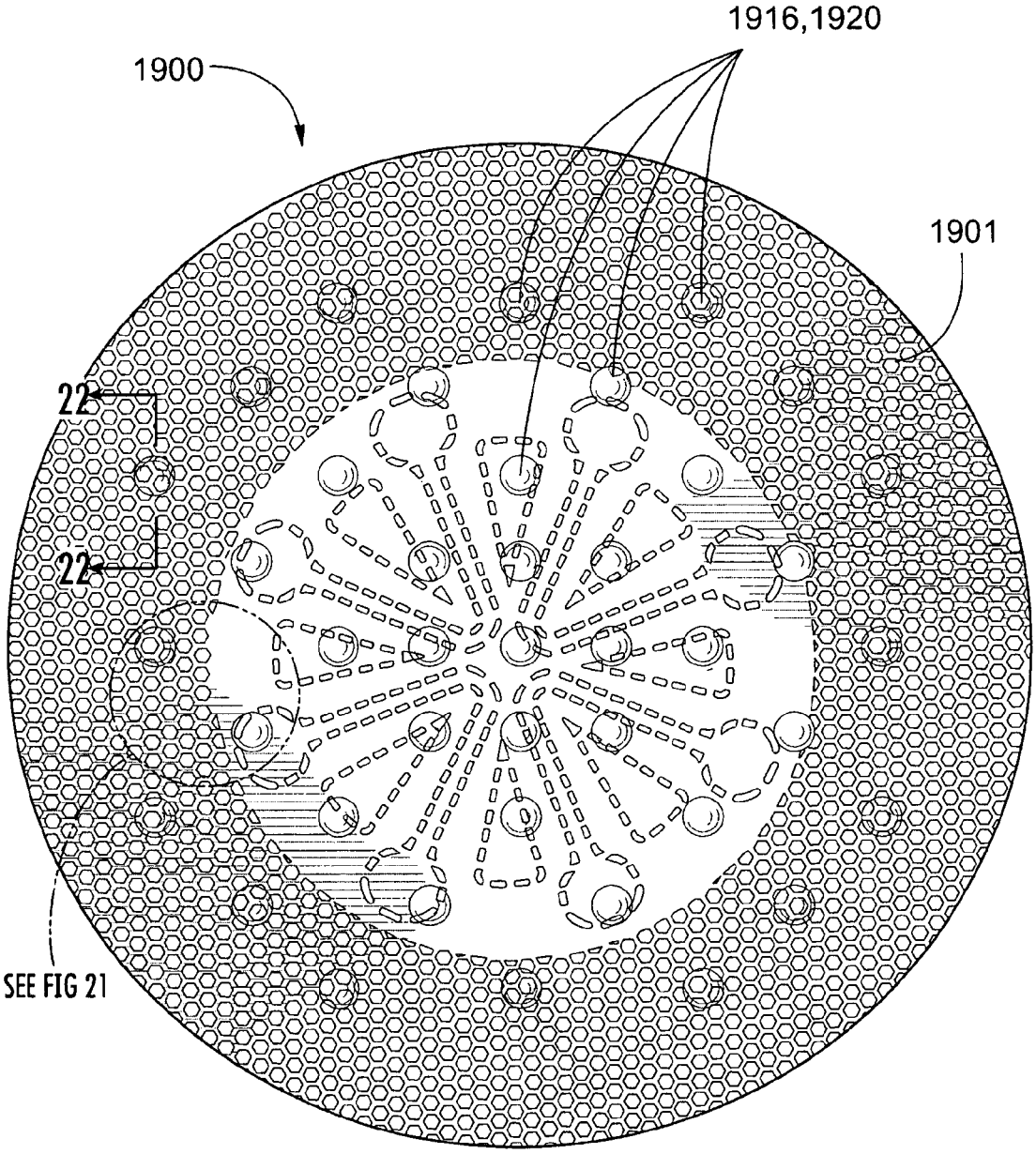
FIG. 20 is a schematic top plan view of the microwave packaging material of FIG. 19.
Figure 21:
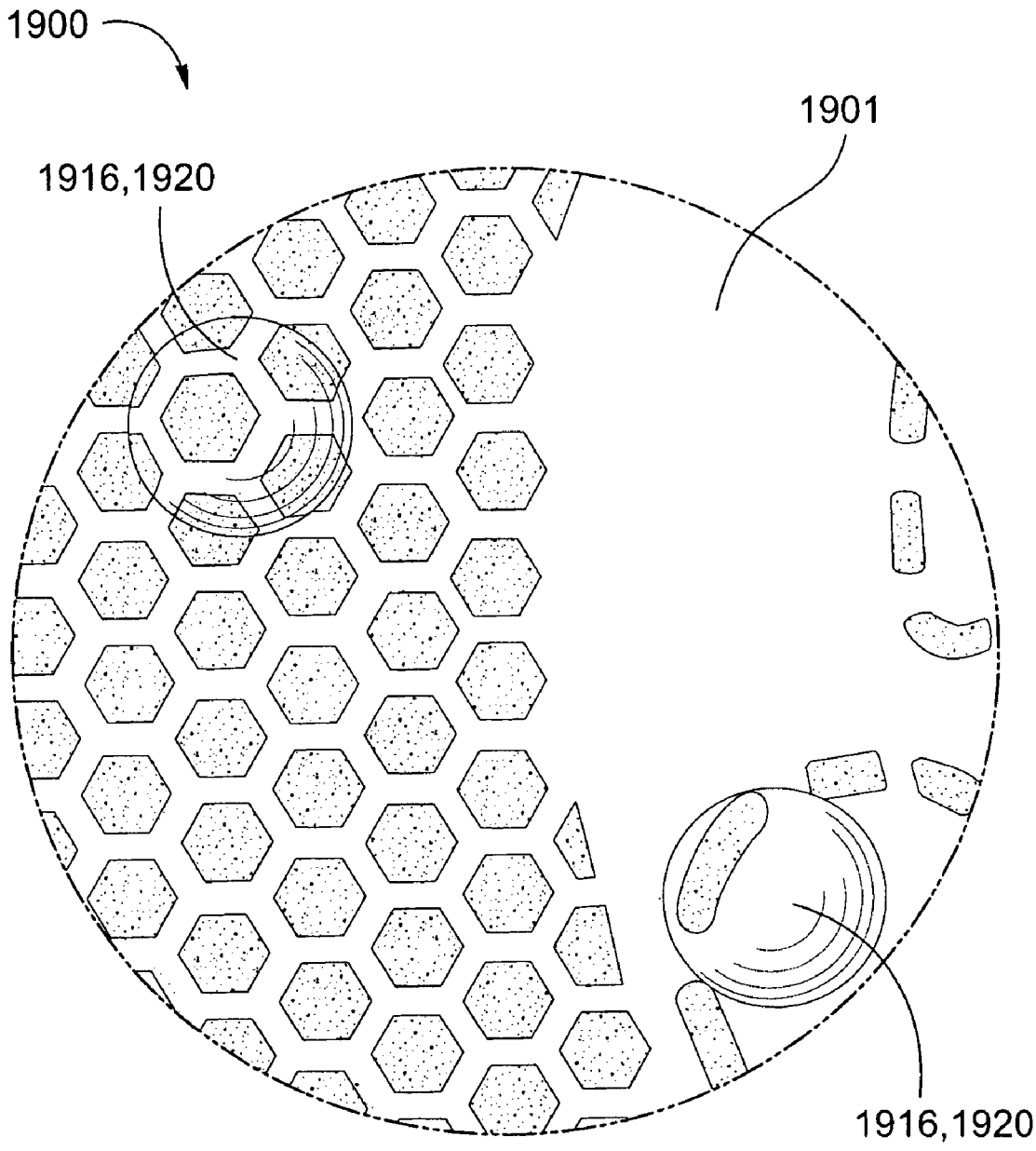
FIG. 21 is a schematic, relatively enlarged, plan view of a portion designated in FIG. 20.

For example, FIG. 18 depicts an indentation pattern of an array of discrete shapes—in this instance circles, but the array could be formed of any type of shape or a combination of shapes—aligned in radial patterns from the center of the microwave packaging material 1800 to the peripheral margin of the microwave packaging material 1800. In this embodiment, the indentation patterns are designed to augment the insulation and microwave propagation properties of the present invention, rather than the venting properties, by raising the microwave packaging material 1800 above the glass tray or other base surface in a microwave oven.

In an alternative embodiment, the indentation pattern of FIG. 18 might protrude upward from the surface of the microwave packaging material 1800 upon which the food product rests, for example, as bumps 1824. In this case, the microwave propagation characteristics of the microwave packaging material 1800 would be the most prominent, as the food product would be raised above the microwave packaging material 1800 by the bumps 1824 creating a pattern of gaps. Some amount of moisture venting through the pattern of gaps would also occur. This type of indentation configuration may be beneficial if the microwave packaging material 1800 itself is not designed to increase the heating effects of the microwave oven (e.g., if the microwave packaging material 1800 does not include the aluminum layer 104 of FIG. 1 to create a susceptor). As an alternative way of viewing this concept, if the heating effect desired is best achieved by increased microwave propagation, including a susceptor film 105 as in FIG. 1 with the bump pattern 1824 in the microwave packaging 1800 would result in an ineffective susceptor effect, because a susceptor film 105 best functions when there is substantial and continuous direct contact between the microwave packaging material 1800 and the food product. This substantial and continuous contact is impaired because the bumps 1824 would raise the food product away form the majority of the surface area of the microwave packaging material 1800.

On the other hand, it can be advantageous in many situations for indentations of the indentation pattern of FIG. 18 to protrude upwardly from the surface of the microwave packaging material 1800 upon which the food product rests, for example, as bumps 1824, and for the microwave packaging material 1800 to be designed to increase the heating effects of the microwave oven (e.g., by including the aluminum layer 104 of FIG. 1 to create a susceptor). Indeed, in any of the above-discussed indentation patterns, the indentations (e.g., indentation lines) can protrude upwardly from the susceptor surface of the microwave packaging material upon which the food product rests.

As another example, FIGS. 19-23 illustrate a microwave packaging material 1900 in accordance with another embodiment of the present invention. The embodiment of FIGS. 19-23 can be like the above-described embodiments, except for variations noted and variations that will be apparent to those of ordinary skill in the art. As best understood with reference to FIG. 22, the microwave packaging material 1900 includes a susceptor/microwave interactive material layer 1901 supported upon a substrate 1914. The substrate 1914 and the microwave interactive material layer 1901 can be as described above, for example with reference to FIG. 1. That is, the microwave interactive material layer 1901 can include an etched foil pattern (e.g., see etched foil pattern 108 illustrated in FIGS. 1A and 2) generally sandwiched between a susceptor film (e.g., see the susceptor film 105 illustrated in FIG. 1A) and the substrate 1914.

More specifically, the microwave packaging material 1900 can be like the microwave packaging material 100 of FIGS. 1A, 1B and 2, except that the microwave packaging materials 1900 and 100 have differently configured indentation patterns and differently configured etched foil patterns. For example, the stippling in FIG. 21 denotes (i.e., has been applied to) the etched foil pattern, to distinguish the etched foil pattern from the relatively thin, continuous layer of aluminum, or the like, of the susceptor film. That is, the relatively thin aluminum, or the like, of the susceptor film is not illustrated by stippling in FIG. 21.

The microwave packaging material 1900 includes a pattern of indentations 1916 that are circles-shaped. Only a representative few of the indentations 1916 are specifically identified by their reference numerals in FIGS. 19 and 20 in order to clarify the views. As best understood with reference to FIG. 22, each of the indentations 1916 includes a concave portion 1918 and a convex portion 1920. The concave portions 1918 are defined by the outer surface of the substrate 1914. In contrast, the convex portions 1920 are defined by the outer surface of the interactive material layer 1901. The outer surface of the interactive material layer 1901 is for supporting the food product to be cooked in association with the microwave packaging material 1900.

Figure 22:
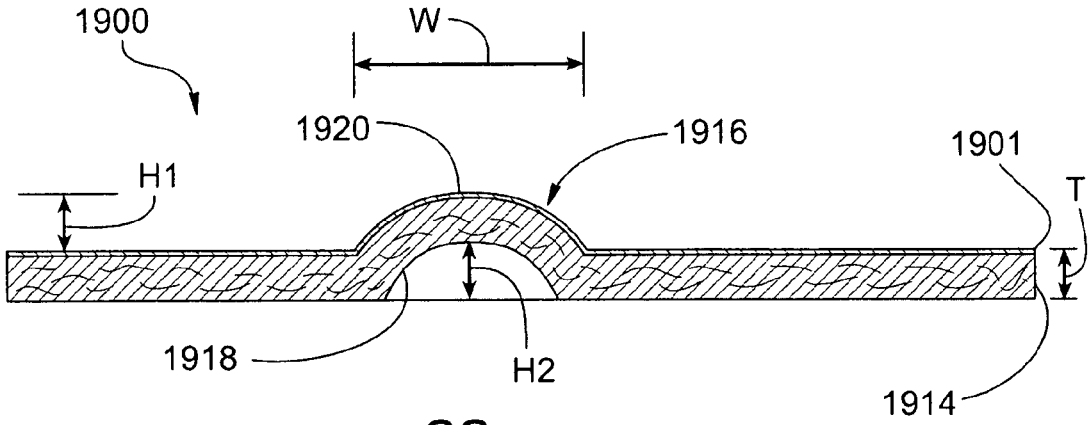
FIG. 22 is a schematic, cross-sectional view of a portion designated in FIG. 20 by the lines 22-22.
Figure 23:
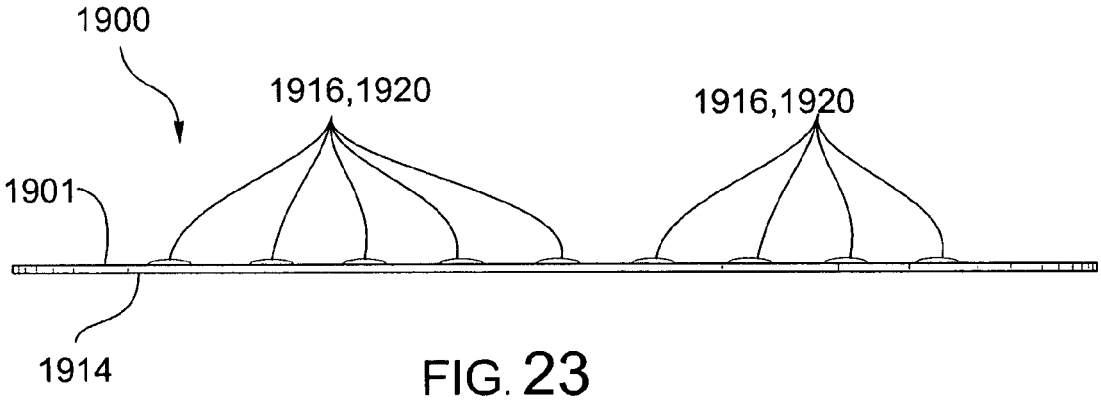
FIG. 23 is a side elevation view of the microwave packaging material of FIG. 19.

Further referring to FIG. 22, the convex portions 1920 extend a maximum height H1 above substantially flat, coplanar surfaces of the outer surface of the interactive material layer 1901. The concave portions 1918 extend a maximum height H2 above substantially flat, coplanar surfaces of the outer surface of the substrate 1914. The height H2 can also be referred to as depth. In accordance with one specific example, the microwave packaging material 1900 has a thickness T (measured at a location that does not include an indentation 1916) of about 1 millimeter, the indentations 1916 have a width W of about 5.0 millimeters, the maximum height H1 is about 0.5 millimeters, and the maximum height H2 is about 0.5 millimeters. In accordance with another specific example, the microwave packaging material 1900 has a thickness T of about 0.8 millimeters, the indentations 1916 have a width W of about 5.0 millimeters, the maximum height H1 is about 0.5 millimeters, and the maximum height H2 is about 0.5 millimeters. Accordingly, the heights H1 and H2 can be less than the thickness T.

More generally, the thickness T can be in a range of about 0.254 millimeters to about 1.270 millimeters. More specifically, the thickness T can be in a range of about 0.508 millimeters to about 1.635 millimeters. More generally, the width W can be in a range of about 3 millimeters to about 5 millimeters. More generally, each of the heights H1 and H2 can be in a range of about 0.3 millimeters to about 8 millimeters. More specifically, each of the heights H1 and H2 can be in a range of about 0.5 millimeters to about 8 millimeters. More specifically, each of the heights H1 and H2 can be in a range of about 1 millimeter to about 8 millimeters. In one specific example, the heights H1 and H2 are about 3 millimeters.

Figure 24:
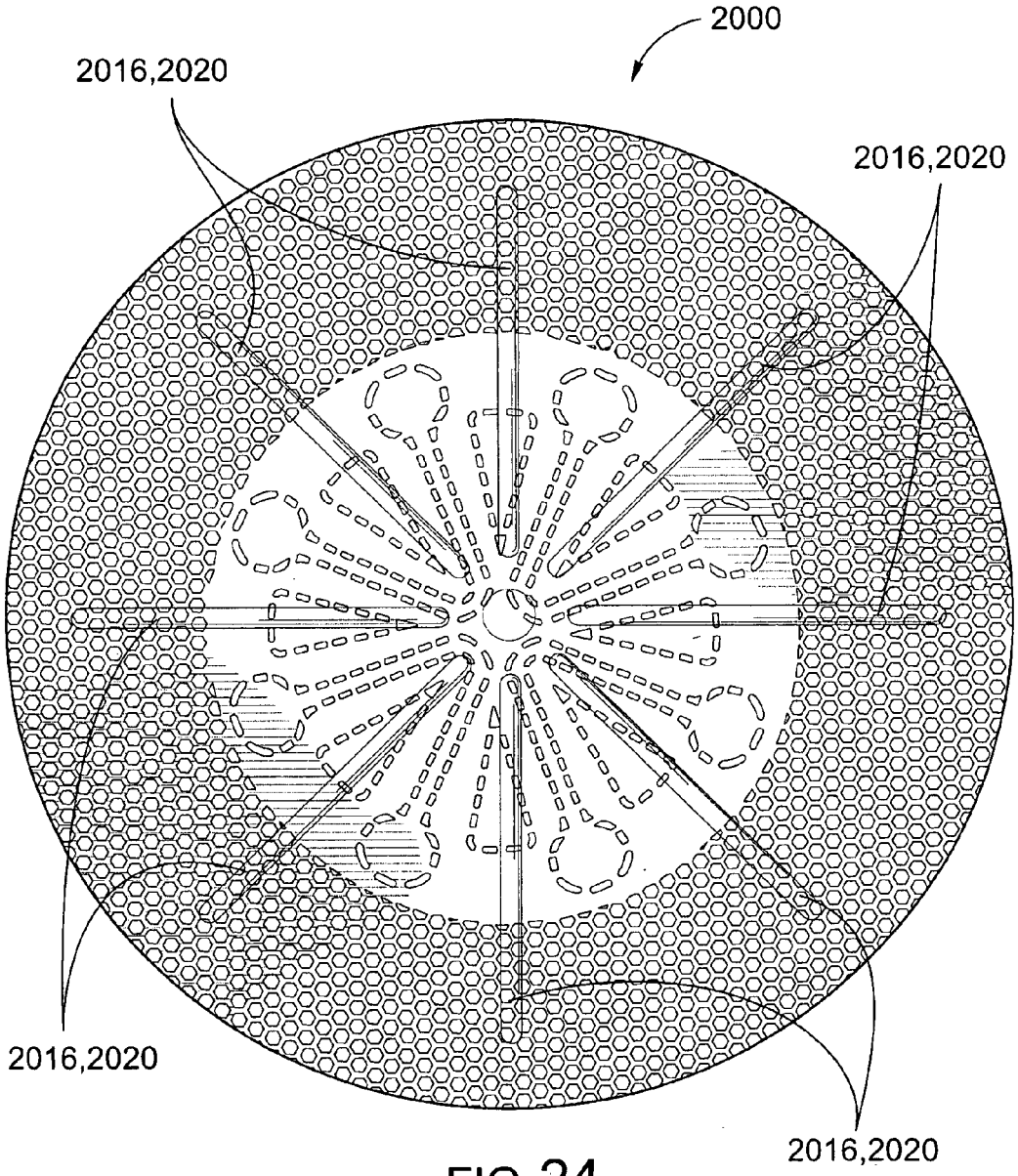
FIG. 24 is a schematic top plan view of a microwave packaging material with an indentation pattern in accordance with another embodiment of the present invention.

Whereas the indentations 1916 have been described as being in the shape of circles, they can be in a wide variety of other shapes, such as the shapes of the above-described indentation lines. For example, the FIG. 24 illustrates a microwave packaging material 2000 that is like the microwave packaging material 1900, except that the indentations 2016 are elongate. Whereas eight elongate indentations 2016, with their convex portions 2020, are shown in FIG. 24, there can be more or less. In other versions of the microwave packaging material 2000 there are 4, 6 or 16 elongate indentations 2016. In one specific example of the microwave packaging material 2000 that includes sixteen elongate indentations 2016, each of the elongate indentions is about 2 millimeters wide and about 2 millimeters deep. The elongate indentations 1916 can be shaped differently than illustrated in FIG. 24; for example the elongate indentions are not required to be straight. For example, the elongate indentations 1916 can be shaped like any of the above-described indentation lines.

The indentation patterns of FIGS. 19-24 typically do not extend all the way to the peripheral edge of the microwave packaging material. In some examples, the indentations 1916 and 2016 can be as close as about 0.5 centimeters or a few millimeters from the peripheral edge of the microwave packaging material. Keeping the indentations 1916 and 2016 away from the peripheral edge of the microwave packaging material can advantageously help to maintain the structural integrity of the packaging material and help to limit the amount of venting from the space between the upper surface of the packaging material and the food being cooked on the upper surface of the packaging material. Limiting the amount of venting from the space between the upper surface of the packaging material and the food being cooked on the upper surface of the packaging material can help to keep the food from becoming too dry. In addition, the indentation patterns of FIGS. 19-24 can help to enable denesting of the microwave packaging materials that are stacked one upon the other.

The indentation patterns of FIGS. 19-24 can be varied in many different ways. For example, an indentation pattern for a single piece of microwave packaging material can include both circular indentations 1916 and elongate indentations 2016, and the circular indentations 1916 can be modified to be in shapes other than circles.

Although various embodiments of this invention have been described above with a certain degree of particularity, or with reference to one or more individual embodiments, those skilled in the art could make numerous alterations to the disclosed embodiments without departing from the spirit or scope of this invention. It is intended that all matter contained in the above description and shown in the accompanying drawings shall be interpreted as illustrative only of particular embodiments and not limiting. Changes in detail or structure may be made without departing from the basic elements of the invention as defined in the following claims.

What is claimed is:

1. A microwave packaging material comprising:

a laminate material including a substrate and a microwave interactive material layer supported upon the substrate; and a plurality of indentations in the laminate material, wherein the indentations are at least partially defined by the microwave interactive layer and substantially maintain the integrity of the microwave interactive layer, wherein a first side of the microwave interactive layer faces away from the substrate and includes a plurality of substantially flat, coplanar surfaces that are at least partially separated from one another respectively by the indentations, for each of at least some of the indentations (a) the indentation includes a convex portion defined by the first side of the microwave interactive layer, and (b) the convex portion extends above the substantially flat, coplanar surfaces of the first side of the microwave interactive layer while the substantially flat, coplanar surfaces are facing upward, a first side of the substrate faces away from the microwave interactive layer and includes a plurality of substantially flat, coplanar surfaces that are at least partially separated from one another respectively by the indentations, a thickness is defined between (a) the substantially flat, coplanar surfaces of the first side of the microwave interactive layer, and (b) the substantially flat, coplanar surfaces of the first side of the substrate, for each of the at least some of indentations, the convex portion extends a maximum distance above the substantially flat, coplanar surfaces of the first side of the microwave interactive layer, and the maximum distance is less than the thickness.

2. The microwave packaging material according to claim 1, wherein the indentations are not fold lines.

3. The microwave packaging material according to claim 1, wherein the microwave interactive layer includes a susceptor film.

4. The microwave packaging material according to claim 1, wherein the microwave interactive layer includes an abuse-tolerant metallic pattern.

5. The microwave packaging material according to claim 1, wherein none of the indentations is contiguous with a peripheral edge of the laminate material.

6. The microwave packaging material according to claim 1, wherein the substrate comprises paperboard.

7. The microwave packaging material according to claim 1, wherein:

for each of the at least some of the indentations, the indentation is respectively positioned between at least two of the substantially flat, coplanar surfaces of the first side of the microwave interactive layer, and in a plan view of the first side of the microwave interactive layer, a summation of all areas of the first side that are in the form of the substantially flat, coplanar surfaces exceeds a summation of all areas of the first side that are in the form of the indentations.

8. The microwave packaging material according to claim 1, wherein for each of the at least some of the indentations, the indentation includes a concave portion defined by the first side of the substrate.

9. The microwave packaging material according to claim 8, wherein:

for each of the at least some of the indentations, the indentation is elongate, the elongate indentions extend radially toward a peripheral edge of the laminate material, and the elongate indentions are discontinuous with the peripheral edge of the laminate material.

10. The microwave packaging material according to claim 1, wherein for each of the at least some of the indentations, the indentation is elongate.

11. The microwave packaging material according to claim 10, wherein the elongate indentions extend radially toward a peripheral edge of the laminate material.

12. The microwave packaging material according to claim 11, wherein the elongate indentions are discontinuous with the peripheral edge of the laminate material.

13. The microwave packaging material according to claim 10, wherein the indentations substantially maintain the integrity of the microwave interactive layer.

14. The microwave packaging material according to claim 10, wherein the indentations are not fold lines.

15. The microwave packaging material according to claim 10, wherein for each of the at least some of the indentations, the indentation further includes a concave portion defined by a side of the substrate that faces away from the microwave interactive material.

16. The microwave packaging material according to claim 10, wherein for each of the at least some of the indentations, the maximum distance is in a range of about 0.3 millimeters to about 8 millimeters.

17. The microwave packaging material according to claim 16, wherein for each of the at least some of the indentations, the maximum distance is in a range of about 0.5 millimeters to about 8 millimeters.

18. The microwave packaging material according to claim 17, wherein for each of the at least some of the indentations, the maximum distance is about 0.5 millimeters.

19. The microwave packaging material according to claim 16, wherein for each of the at least some of the indentations, the maximum distance is in a range of about 1 millimeter to about 8 millimeters.

20. The microwave packaging material according to claim 19, wherein for each of the at least some of the indentations, the maximum distance is about 3 millimeters.

21. The microwave packaging material according to claim 16, wherein for each of the at least some of the indentations, the convex portion has a width, and the width is in a range of about 3 millimeters to about 5 millimeters.

22. The microwave packaging material according to claim 16, wherein the thickness is within at least one range selected from the group consisting of:

a range of about 0.508 millimeters to about 1.635 millimeters, and a range of about 0.254 millimeters to about 1.27 millimeters.

23. The microwave packaging material according to claim 16, wherein the thickness is within the range of about 0.508 millimeters to about 1.635 millimeters.

24. The microwave packaging material according to claim 16, wherein the thickness is within the range of about 0.254 millimeters to about 1.27 millimeters.

25. The microwave packaging material according to claim 10, wherein for each of the at least some of the indentations, the convex portion has a width, and the width is about 2 millimeters.

26. The microwave packaging material according to claim 10, wherein for each of the at least some of the indentations, the convex portion has a width, and the width is in a range of about 3 millimeters to about 5 millimeters.

27. The microwave packaging material according to claim 26, wherein for each of the at least some of the indentations, the width is about 5 millimeters.

28. The microwave packaging material according to claim 10, wherein the thickness is within at least one range selected from the group consisting of:

a range of about 0.508 millimeters to about 1.635 millimeters, and a range of about 0.254 millimeters to about 1.27 millimeters.

29. The microwave packaging material according to claim 1, wherein for each of the at least some of the indentations, the maximum distance, which the convex portion extends above the substantially flat, coplanar surfaces of the first side of the microwave interactive layer, is in a range of about 0.3 millimeters to about 8 millimeters.

30. The microwave packaging material according to claim 1, wherein for each of the at least some of the indentations, the convex portion has a width, and the width is about 2 millimeters.

31. The microwave packaging material according to claim 1, wherein for each of the at least some of the indentations, the convex portion has a width, and the width is in a range of about 3 millimeters to about 5 millimeters.

32. The microwave packaging material according to claim 1, wherein the thickness is within at least one range selected from the group consisting of:

a range of about 0.508 millimeters to about 1.635 millimeters, and a range of about 0.254 millimeters to about 1.27 millimeters.

* * * * *